US008225761B2

(12) United States Patent
Cho et al.

(10) Patent No.: US 8,225,761 B2
(45) Date of Patent: Jul. 24, 2012

(54) VALVE GEAR FOR INTERNAL COMBUSTION ENGINES

(75) Inventors: Masaki Cho, Saitama (JP); Toshiyuki Sato, Saitama (JP); Takahiro Imafuku, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 320 days.

(21) Appl. No.: 12/723,485

(22) Filed: Mar. 12, 2010

(65) Prior Publication Data

US 2010/0242875 A1 Sep. 30, 2010

(30) Foreign Application Priority Data

Mar. 27, 2009 (JP) ..... 2009-080310
Mar. 27, 2009 (JP) ..... 2009-080311
Mar. 27, 2009 (JP) ..... 2009-080312

(51) Int. Cl.
*F01L 1/34* (2006.01)

(52) U.S. Cl. ..... 123/90.16; 123/90.39; 123/90.44; 123/90.65; 74/559; 74/569

(58) Field of Classification Search ..... 123/90.16, 123/90.39, 90.44, 90.65; 74/559, 567, 569
See application file for complete search history.

(56) References Cited

U.S. PATENT DOCUMENTS 7,467,609 B2 * 12/2008 Naumann ..... 123/90.16

FOREIGN PATENT DOCUMENTS

JP 2005-207255 8/2005
JP 2008-208800 11/2008

* cited by examiner

*Primary Examiner* — Ching Chang
(74) *Attorney, Agent, or Firm* — Birch, Stewart, Kolasch & Birch, LLP

(57) ABSTRACT

A valve gear for an internal combustion engine having a sub-rocker arm return spring that is shortened in a longitudinal length of a cylinder. The valve gear for the internal combustion engine is provided with a camshaft, an intake cam turning integrally with the camshaft, a valve cam for opening and closing an engine valve, a link mechanism for transmitting a valve driving force to the valve cam, a holder for supporting a sub-rocker arm support and a driving mechanism for varying a fulcrum position of the link mechanism. A valve operating characteristic can be varied with an oscillating position of the sub-rocker arm support. A sub-rocker arm is provided with a roller, an eccentrically disposed step and a link section. The step is provided with a spring socket, and a return spring is arranged intervening between the spring socket and the holder.

20 Claims, 14 Drawing Sheets

FI.G 1

VALVE GEAR FOR INTERNAL COMBUSTION ENGINES

CROSS-REFERENCE TO RELATED APPLICATIONS

The present application claims priority under 35 USC 119 to Japanese Patent Application No. 2009-080310 filed on Mar. 27, 2009; Japanese Patent Application No. 2009-080311 filed on Mar. 27, 2009; Japanese Patent Application No. 2009-080312 filed on Mar. 27, 2009, the entire contents of which are hereby incorporated by reference.

BACKGROUND OF THE INVENTION

1. Field of the Invention

The present invention relates to a valve gear for an internal combustion engine, the device being provided with a function to make variable the valve operating characteristics of the opening and dosing of engine valves.

2. Description of Background Art

Valve gears are known for internal combustion engines is provided with a drive cam that rotates integrally with a camshaft supported by cylinder heads, a valve cam that is oscillably supported by the camshaft and opens and closes engine valves, a link mechanism that is oscillably supported centrally by the camshaft and transmits the valve driving force of the drive cam to the valve cam and oscillates the valve cam, a holder which, centering on a fulcrum provided on the link mechanism, can turn around the camshaft, and a driving mechanism that varies the fulcrum position of the link mechanism by turning this holder, and can make variable the valve operating characteristics of the engine valves according to the oscillating position of the oscillated link mechanism (See, for example, JP-A No. 2008-208800).

The known valve gear for internal combustion engines as disclosed in JP-A 2008-208800 involves a problem that the longitudinal length of the cylinder head is increased by the arrangement of a coil spring (a sub-rocker aim return spring), which presses the sub-rocker arm constituting the link mechanism against the drive cam, in the longitudinal direction of the vehicle. Further, as a compression coil spring (return spring) for the valve cam is provided between the holder and the valve cam for opening and closing the engine valves in a compressed state between the valve cam and the holder, the coil spring should be compressed when the holder is to be fitted, making the fitting work difficult.

Another known valve gear for internal combustion engines is disclosed in JP-A 2005-207255. It has a configuration in which the holder has a pair of plates inserted into the camshaft and so arranged as to hold the drive cam between them and the drive cam is pressure-fitted into and fixed in the camshaft, it is possible, in assembling the valve gear, to pressure-fit the drive cam after inserting one of the plates into the camshaft and then to insert the other plate into the camshaft. However, this configuration takes many man-hours to assemble because the drive cam formed as another element from the camshaft is to be pressure-fitted.

SUMMARY AND OBJECTS OF THE INVENTION

In view of these problems, the present invention is intended to help reduce the number of man-hours required for assembling by simplifying the assembly of a valve gear for use in internal combustion engines. In addition, the present invention is intended to help shorten the longitudinal length of the cylinder head by arranging the sub-rocker arm return spring compactly in the valve gear for internal combustion engines.

According to an embodiment of the present invention, a valve gear for an internal combustion engine is provided with a camshaft that rotates in synchronism with revolution of the internal combustion engine, a drive cam that integrally rotates with the camshaft, a valve cam that rotates relative to the camshaft and opens and closes an engine valve, a link mechanism that transmits valve driving force of the drive cam to the valve cam, a holder member that supports a supporting shaft of the link mechanism and is oscillable around the camshaft, and a driving mechanism that varies a fulcrum position of the link mechanism by oscillating the holder member, a valve operating characteristic of opening and closing of the engine valve being made variable with the supporting shaft oscillating position of the link mechanism. In addition, the link mechanism is provided with a sub-rocker arm which oscillates pivoting on the supporting shaft the fulcrum; the sub-rocker arm is provided with a pressing part that presses a cam surface of the drive cam, a step that is disposed eccentrically in an axial direction of the camshaft, and a link section that is linked to the valve cam; the step is provided with a spring socket; and a return spring 58 of the sub-rocker arm is disposed intervening between the spring socket and the holder member.

This configuration enables the return spring to be arranged compactly, as the socket for the return spring of the sub-rocker arm is formed in the step that is disposed eccentrically in the axial direction of the camshaft and the return spring 58 is supported between this socket and the holder member. For example, the length that the return spring occupies in the longitudinal direction of the vehicle can be shortened by arranging the socket and the holder member in the vertical direction of the vehicle and supporting the return spring in the vertical direction of the vehicle between the socket and the holder member. This enables the return spring to be arranged compactly in the longitudinal direction and the longitudinal length of the cylinder heads to be shortened.

In the foregoing configuration, the holder member may be provided with a through hole that vertically penetrates, and inserts and holds the return spring 58.

In this case, as the return spring is held within the vertically penetrating through hole, the longitudinal length of the cylinder heads can be shortened by arranging the return spring 58 in the vertical direction of the vehicle and arranging the return spring 58 compactly in the longitudinal direction.

Also, the return spring 58 can be arranged compactly, as the vertically penetrating through hole is provided in the holder member, the return spring is disposed in this through hole and the return spring is housed inside the holder member. Furthermore, as the return spring 58 is inserted into and held within the through hole, the return spring 58 can be inserted and assembled after assembling the parts of the valve gear, resulting in assembling ease.

Further, the holder member may be provided with a pair of left and right holder plates and a coupling member connecting the upper parts of the holder plates and the through hole may be provided in the coupling member.

In this case, as the through hole is formed within the coupling member connecting the upper parts of the holder plates and the through hole is positioned above the holder member, the return spring 58 can be easily inserted from above, resulting in assembling ease.

According to an embodiment of the present invention, a valve gear for an internal combustion engine is provided with a camshaft that rotates in synchronism with revolution of the internal combustion engine, a drive cam that integrally rotates with the camshaft, a valve cam that rotates relative to the camshaft and opens and closes an engine valve, a link mechanism that transmits valve driving force of the drive cam to the valve cam, a pair of holder plates that support a fulcrum of the link mechanism and are oscillable around the camshaft, and a driving mechanism that varies a fulcrum position of the link mechanism by oscillating the holder plates, a valve operating characteristic of opening and closing of the engine valve being made variable with a fulcrum oscillating position of the link mechanism, wherein: the drive cam is formed integrally with the camshaft, a through hole to let the drive cam pass is formed at the time of fitting the inner holder plate, and the holder plate is supported from outside the through hole.

This configuration, as the drive cam is formed integrally with the camshaft, can dispense with such tasks as pressure-fitting the drive cam into the camshaft at the fitting stage, serves to simplify the assembling of the valve gear, and can thereby contribute to reducing the man-hours needed for assembling. In terms of the fitting procedure, as the through hole in the inner holder plate is made greater than the outer diameter of the drive cam formed integrally with the camshaft, the inner holder plate can be moved toward the inner part of the drive cam through the drive cam integral with the camshaft and arranged there. Therefore, assembling of the valve gear is simplified, making possible a reduction in required man-hours.

Furthermore, as the holder plates are supported externally and can be supported from outside after the holder plates are inserted into the camshaft, assembling is accordingly simplified.

In the foregoing configuration, the valve cam may be disposed adjacent to the drive cam, a shaft diameter of a valve cam supporting part of the camshaft may be formed greater than the shaft diameter on a counter-drive cam side, a camshaft collar may be inserted from the counter-drive cam side of the camshaft, and an edge of the camshaft collar may be brought into contact with a step of the valve cam supporting part to position the valve cam.

According to this configuration, since it is possible to form the valve cam supporting part greater than the shaft diameter on the counter-drive cam shaft to form the step, bring the edge of the camshaft collar into contact with the step to insert the camshaft collar into the camshaft, and regulate the position of the valve cam with the edge of the camshaft collar, the vale cam is positioned in the axial direction of the camshaft.

Also, an outer circumferential surface of the camshaft collar may be used as a plain bearing to support the camshaft.

In this case, as not only the camshaft collar is used as the positioning member of the valve cam but also the outer circumferential surface of the camshaft collar is used as the plain bearing to support the camshaft, the number of components can be reduced. Furthermore, as the number of components is reduced, the man-hours required for assembling can also be reduced.

Also, the pair of holder plates may be formed into a solid body by being fastened with bolts to a sub-rocker arm supporting member supporting the fulcrum of the link mechanism.

In this case, as the pair of holder plates are formed into a solid body with the sub-rocker arm supporting member by bolting, it is possible to fit other components of a valve mechanism to the sub-rocker arm supporting member and holder plates before fastening with bolts and then to fasten the holder plates. This serves to enhance the freedom in structuring and assembling of the valve gear. Furthermore, as individually fastening each of the paired holder plates to the sub-rocker arm supporting member enables individual components of the valve mechanism to be fastened and fitted in a phased manner, the components being fitted can be prevented from coming off, resulting in increased assembling ease.

According to an embodiment of the present invention, a valve gear for an internal combustion engine is provided with a camshaft that rotates in synchronism with revolution of the internal combustion engine, a drive cam that integrally rotates with the camshaft, a valve cam that rotates relative to the camshaft and opens and closes an engine valve, a link mechanism that transmits valve driving force of the drive cam to the valve cam, a holder member that supports a fulcrum of the link mechanism and is oscillable around the camshaft, and a driving mechanism that varies a fulcrum position of the link mechanism by oscillating the holder member, a valve operating characteristic of opening and closing of the engine valve being made variable with the fulcrum oscillating position of the link mechanism. A return spring 57 of the valve cam is formed of a torsion coil spring fitted to the camshaft, one end of the spring is engaged with the valve cam, and the other end thereof is engaged with the holder member.

This configuration, as the return spring 57 of the valve cam formed of a torsion coil spring is fitted to the camshaft, the arrangement of the return spring is simple and enables the space for return spring arrangement to be made smaller. Also, as one end of the return spring 57 is engaged with the valve cam and the other end of the return spring 57 is engaged with the holder member, the return spring can be easily fitted onto the camshaft. Furthermore, as the return spring 57 is a torsion coil spring fitted to the camshaft, any work to be done while compressing the return spring is dispensed with, resulting in simplified assembling. Also, as the return spring 57 is fitted onto the camshaft, the valve gear can be made smaller in size and a cylinder head can be made more compact.

Further in the foregoing configuration, the camshaft collar may be inserted into the camshaft as to permit positioning of the valve cam and a return spring keep flange may be provided on the valve cam side of the camshaft collar.

In this configuration, the valve cam can be positioned with the return spring keep flange of the camshaft collar, and at the same time the return spring 57 can be positioned by bringing the return spring into contact with the return spring keep flange.

Further, the holder member may be provided with a pair of left and right holder plates, and equipped with a supporting member fitted between the pair of holder plates to serve as a oscillation fulcrum of the link mechanism, one end of the return spring may be engaged with the supporting member and the other end may be engaged with a supporting hole provided in the valve cam.

In this case, as the return spring 57 of the valve cam can be fitted by engaging one end of the return spring 57 with the supporting member serving as the oscillation fulcrum of the link mechanism and engaging the other end of the return spring with the supporting hole of the valve cam, there is no need to provide a special engaging member for the return spring and, moreover, fitting can be easily accomplished. This feature makes possible reductions in the number of components and the man-hours required for assembling.

Effects of the invention include the following:

Since the spring socket for the return spring 58 of the sub-rocker arm is formed in the step that is disposed eccentrically in the axial direction of the camshaft and the return spring is supported between this socket and the holder member, the return spring 58 can be arranged compactly in the valve gear for internal combustion engines pertaining to the present invention. For example, the length that the return spring 58 occupies in the longitudinal direction of the vehicle can be shortened by arranging the socket and the holder member in the vertical direction of the vehicle and supporting the return spring in the vertical direction of the vehicle between the socket and the holder member. This enables the return spring 58 to be arranged compactly in the longitudinal direction and the longitudinal length of the cylinder heads to be shortened.

Also, as the return spring 58 is held within the vertically penetrating through hole, the longitudinal length of the cylinder heads can be shortened by arranging the return spring in the vertical direction of the vehicle and arranging the return spring 58 compactly in the longitudinal direction.

Also, as the return spring 58 is housed inside the through hole vertically penetrating the holder member, the return spring 58 can be arranged compactly. Furthermore, as the return spring 58 is inserted into and held within the through hole, the return spring 58 can be inserted and assembled after assembling the parts of the valve gear, resulting in assembling ease.

Further, as the through hole is formed within the coupling member connecting the upper parts of the pair of left and right holder plates and the through hole is positioned above the holder member, the return spring can be easily inserted from above, resulting in assembling ease.

Since the drive cam is formed integrally with the camshaft in the valve gear for internal combustion engines pertaining to the present invention, such tasks as pressure-fitting the drive cam into the camshaft can be dispensed with at the fitting stage, and assembling of the valve gear can be simplified, the man-hours needed for assembling can be reduced. In terms of the fitting procedure, as the through hole in the inner holder plate is made greater than the outer diameter of the drive cam formed integrally with the camshaft, the inner holder plate can be moved toward the inner part of the drive cam through the drive cam integral with the camshaft and arranged there. Therefore, assembling of the valve gear is simplified, making possible a reduction in required man-hours.

Furthermore, as the holder plates are supported externally and can be supported from outside after the holder plates are inserted into the camshaft, assembling is accordingly simplified.

Further, as the camshaft collar is so inserted into the camshaft as to bring an edge of the camshaft collar into contact with a step of the valve cam supporting part and the position of the valve cam can be therefore controlled with the edge of the camshaft collar, the valve cam can be positioned in the axial direction of the camshaft.

Furthermore, as not only the camshaft collar is used as the positioning member of the valve cam but also the outer circumferential surface of the camshaft collar is used as a plain bearing to support the camshaft, the number of components can be reduced. In addition, as the number of components is reduced, the man-hours required for assembling can also be reduced.

Also, as the pair of holder plates are formed into a solid body with the sub-rocker arm supporting member by bolting, it is possible to fit other components of the valve mechanism to the sub-rocker arm supporting member and holder plates before fastening with bolts and then to fasten the holder plates. This serves to enhance the freedom in the structuring and assembling of the valve gear. Furthermore, as individually fastening each of the paired holder plates to the sub-rocker arm supporting member enables individual components of the valve mechanism to be fastened and fitted in a phased manner, the components being fitted can be prevented from coming off, resulting in increased assembling ease.

In addition, since the return spring 57 of the valve cam formed of a torsion coil spring is fitted to the camshaft in the valve gear for internal combustion engines pertaining to the present invention, the arrangement of the return spring 57 is simple and enables the space for return spring arrangement to be made smaller. Also, as one end of the return spring 57 is engaged with the valve cam and the other end of the return spring is engaged with the holder member, the return spring 57 can be easily fitted onto the camshaft. Furthermore, as the return spring 57 is a torsion coil spring fitted to the camshaft, any work to be done while compressing the return spring 57 is dispensed with, resulting in simplified assembling. Also, as the return spring 57 is fitted onto the camshaft, the valve gear can be made smaller in size and a cylinder head can be made more compact.

Further, it is possible to position the valve cam with the return spring keep flange of the camshaft collar and also position the return spring 57 by bringing the return spring into contact with the return spring keep flange.

Further, as the return spring 57 of the valve cam can be fitted by engaging one end of it with the supporting member and engaging the other end with the supporting hole of the valve cam, there is no need to provide a special engaging member for the return spring and, moreover, fitting can be easily accomplished. This feature makes possible reductions in the number of components and the man-hours required for assembling.

Further scope of applicability of the present invention will become apparent from the detailed description given hereinafter. However, it should be understood that the detailed description and specific examples, while indicating exemplary embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A best mode for carrying out the invention will be described below with reference to drawings. In the description, references to directions such as front or rear, left or right and up or down are with respect to the vehicle body.

Figure 1:
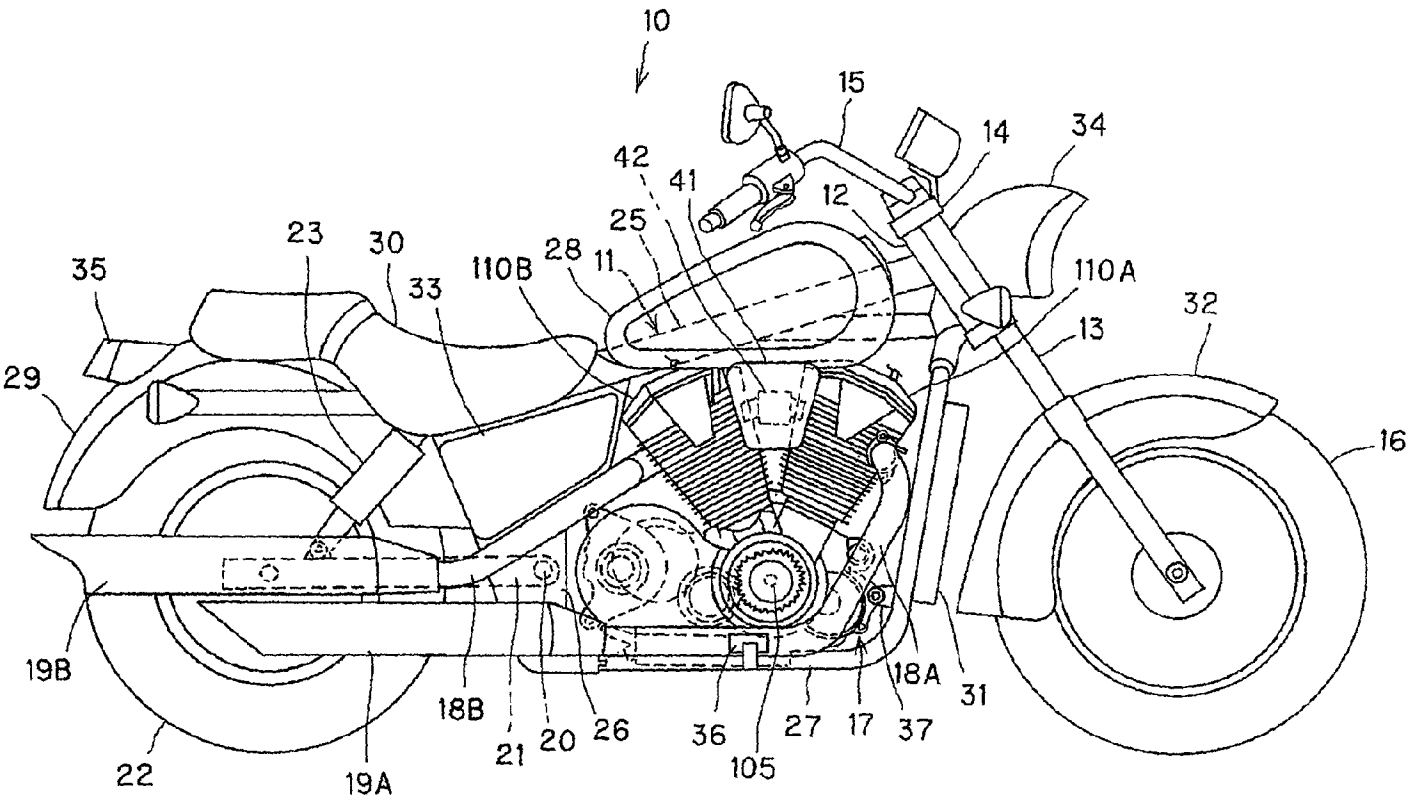
FIG. 1 shows a profile of a cruiser type motorcycle pertaining to an exemplary embodiment of the invention.

FIG. 1 is a profile of a motorcycle to which a valve gear pertaining to an exemplary embodiment of the invention is applied. This motorcycle 10 is provided with a body frame 11, a pair of left and right front forks 13 turnably supported by a head pipe 12 fitted to the front end of the body frame 11, a steering handlebar 15 fitted to a top bridge 14 supporting the upper ends of the front forks 13, a front wheel 16 turnably supported by the front forks 13, an engine 17 as an internal combustion engine supported by the body frame 11, mufflers 19A and 19B linked to the engine 17 via exhaust pipes 18A and 18B, a rear swing arm 21 supported to be vertically oscillable by a pivot 20 in the rear lower part of the body frame 11, and a rear wheel 22 turnably supported by the read end of this rear swing arm 21, wherein a rear cushion 23 is arranged between the rear swing arm 21 and the body frame 11.

The body frame 11 is provided with a main frame 25 extending backward down from the head pipe 12, a pair of left and right pivot plates (also referred to as the center frame) 26 linked to the rear part of the main frame 25 and a down tube 27 bending after extending downward from the head pipe 12 and then extending to be linked to the pivot plates 26. A fuel tank 28 is supported astride the main frame 25, the rear part of the main frame 25 extends to above a rear wheel 22 to support a rear fender 29 and a seat 30 is supported between above this rear fender 29 and the fuel tank 28. To add, in FIG. 1, a reference numeral 31 denotes a radiator supported by the down tube 27; 32, a front fender; 33, a side cover; 34, a headlamp; 35, a tail lamp; and 36, an occupant's step.

The engine 17 is supported in a space surrounded by the main frame 25, the pivot plates 26 and the down tube 27. The engine 17 is a longitudinal V-type two-cylinder water-cooled four-stroke engine whose cylinders are longitudinally banked in a V shape. The engine 17 is so supported by the body frame 11 via multiple engine brackets 37 (only partly shown in FIG. 1) that a crankshaft 105 is directed horizontally left and right with respect to the vehicle body. The motive power of the engine 17 is transmitted to the rear wheel 22 via a drive shaft (not shown) arranged to the left of the rear wheel 22.

The engine 17 is formed of a front bank 110A and a rear bank 110B, each constituting a cylinder, having a clasping angle (also referred to as a bank angle) of less than 90 degrees (e.g. 52 degrees). The valve gear of each of the banks 110A and 110B is configured in a four-valve double overhead camshaft (DOHC) system.

In the V-shaped space formed between the front bank 110A and the rear bank 110B, an air cleaner 41 and a throttle body 42 that constitute the engine air intake system are arranged. The throttle body 42 supplies air cleaned by the air cleaner 41 to the front bank 110A and the rear bank 110B. Further, exhaust pipes 18A and 18B constituting the engine exhaust system are connected to the banks 110A and 110B; the exhaust pipes 18A and 18B pass the right-hand side of the body; exhaust mufflers 19A and 19B are connected to their respective rear ends; and exhaust gas is discharged via these exhaust pipes 18A and 18B and the exhaust mufflers 19A and 19B.

Figure 2:
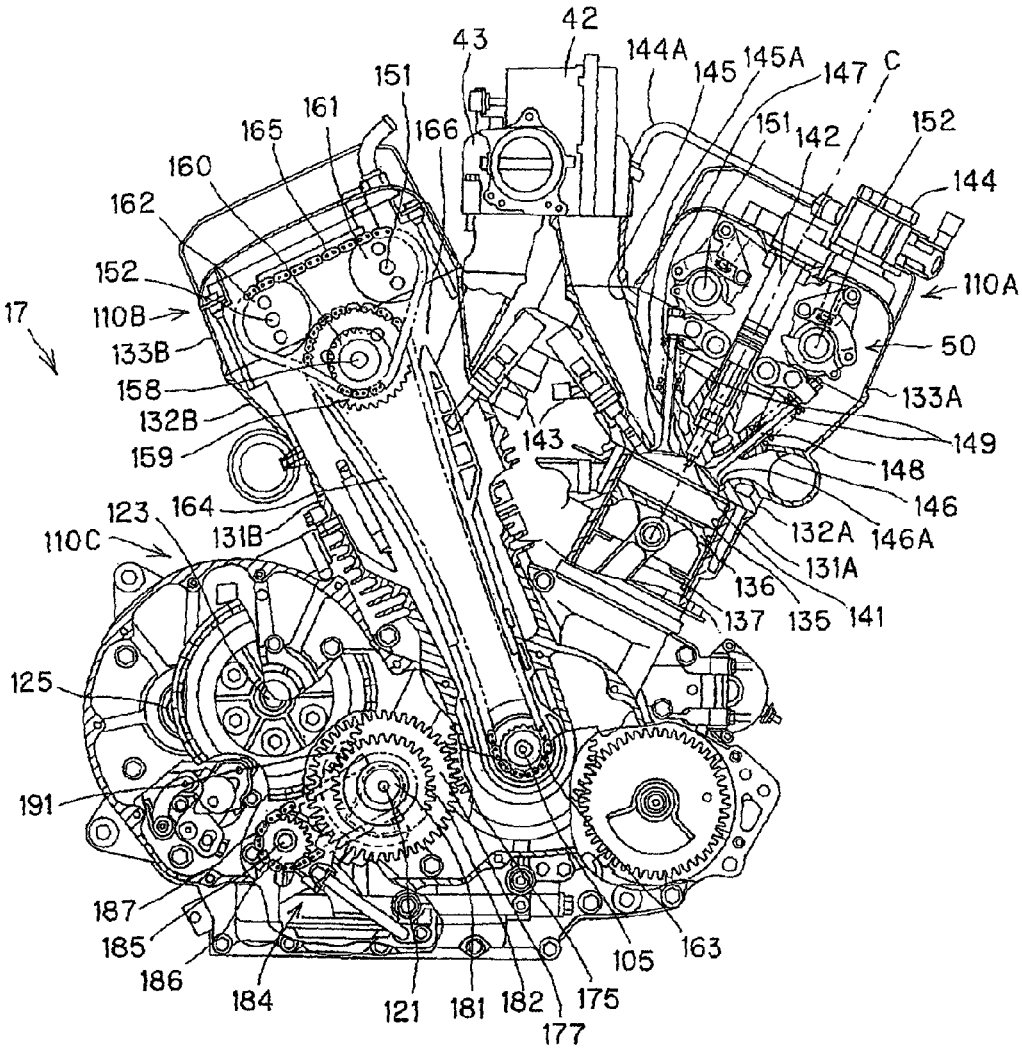
FIG. 2 shows a profile of the internal structure of the engine.
Figure 3:
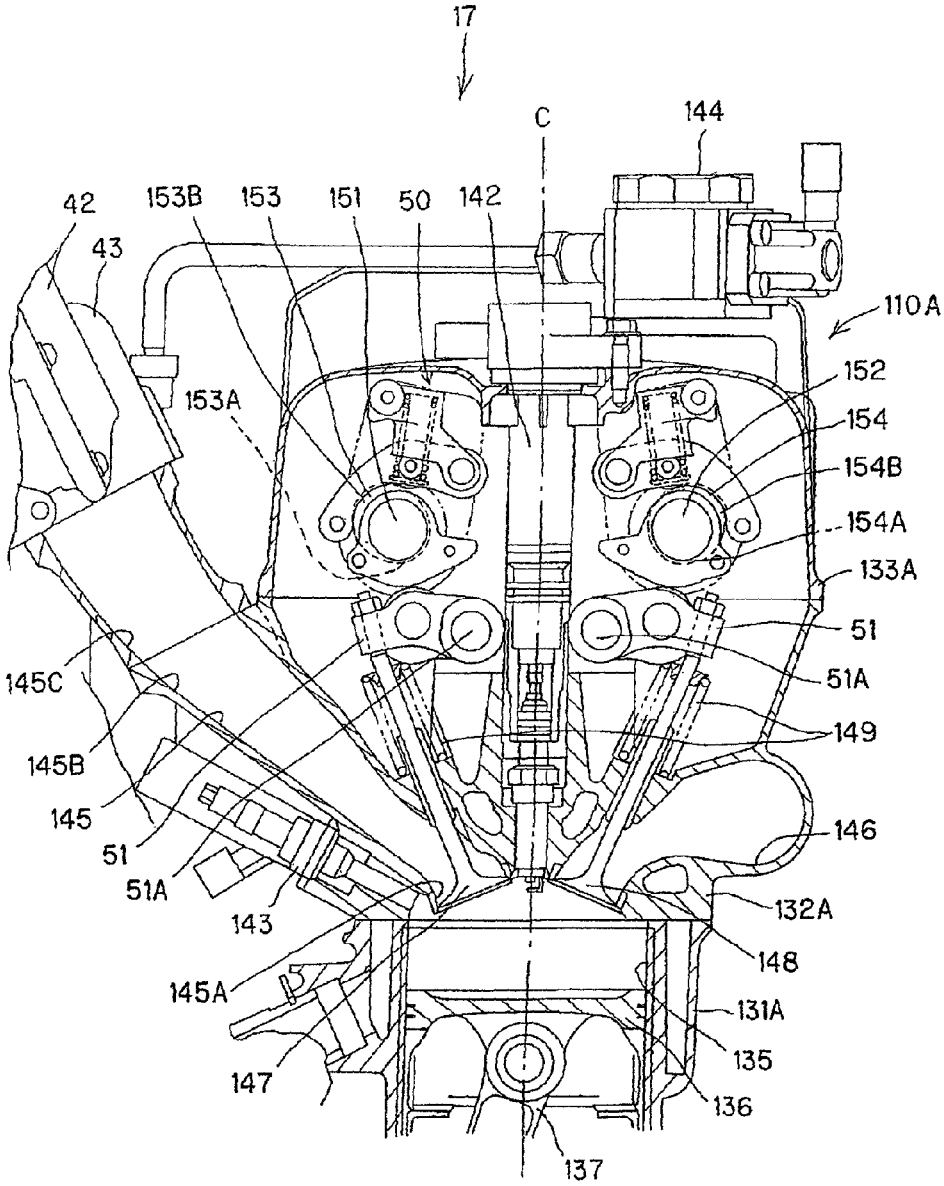
FIG. 3 shows an enlarged view of the internal structure of the front bank in FIG. 2.

FIG. 2 shows a profile of the internal structure of the engine 17, and FIG. 3 shows an enlarged view of the internal structure of the front bank 110A in FIG. 2.

Referring to FIG. 2, the front bank 110A and the rear bank 110B of the engine 17 have the same structure. In FIG. 2, the front bank 110A represents pistons and their surroundings, and the rear bank 110B, a cam chain and its surroundings. Further in FIG. 2, a reference numeral 121 denotes an intermediate shaft (rear side balancer shaft); 123, a main shaft; and 125, a counter shaft. These shafts 121, 123 and 125 including the crankshaft 105 are arranged in parallel to one another, shifted in the longitudinal and vertical directions of the body, and in a crankcase 110C that supports them a gear transmission mechanism which transmits the revolutions of the crankshaft 105 to the intermediate shaft 121, the main shaft 123 and the counter shaft 125 in that order is configured.

As shown in FIG. 2, a front cylinder block 131A and a rear cylinder block 131B are so arranged on the top surface of the crankcase 110C of the engine 17 as to form a prescribed clasping angle in the longitudinal direction of the body, a front cylinder head 132A and a rear cylinder head 132B are respectively coupled with the top surfaces of these cylinder blocks 131A and 131B and, further, head covers 133A and 133B are respectively fitted onto the top surfaces of the cylinder heads 132A and 132B to constitute the front bank 110A and the rear bank 110B.

A cylinder bore 135 is formed in each of the cylinder blocks 131A and 131B; a piston 136 is slidably inserted into each cylinder bore 135, and each piston 136 is linked to the crankshaft 105 via a connecting rod 137.

A combustion concave portion 141 constituting the ceiling surface of a combustion chamber formed above the piston 136 is formed on the bottom surface of each of the cylinder heads 132A and 132B, and an ignition plug 142 is arranged, with its tip protruding out, in each combustion concave portion 141. This ignition plug 142 is disposed substantially coaxially with a cylinder axis C.

The engine 17 is an in-cylinder injection type engine in which fuel is injected directly into the combustion chamber from an injector 143 disposed in each combustion concave portion 141. Each of the injectors 143 is inserted from the inner side surface of the V banks of the cylinder heads 132A and 132B, and is arranged with its tip protruding out into one or the other of the combustion concave portion 141. The injectors 143 are fitted in a lying state relative to the cylinder axis C.

A fuel pump 144 is provided above the cylinder head 132A, and fuel is supplied to each of the injectors 143 from the fuel pump 144 via fuel piping 144A.

In each of the cylinder heads 132A and 132B, an intake port 145 communicating with each combustion concave portion 141 via a pair of openings 145A and an exhaust port 146 communicating with each combustion concave portion 141 via a pair of openings 146A are formed. The intake port 145 is arranged between the cylinder axis C and the injector 143.

Each of the intake ports 145, as shown in FIG. 2 and FIG. 3, is provided with a lower intake port 145B disposed as a solid body with the cylinder heads 132A and 132B and an upper intake port 145C disposed separately from the cylinder heads 132A and 132B. The upper intake port 145C is fitted at a different angle from the lower intake port 145B in the direction of more approaching the head covers 133A and 133B.

Each of the intake ports 145 are confluent in an intake chamber 43, and this intake chamber 43 is linked to the throttle body 42. For the throttle body 42, TBW (throttle by wire) is adopted by which the sectional area of the throttle valve is varied by driving an actuator. The exhaust port 146 of the cylinder head 132A is linked to the exhaust pipe 18A (see FIG. 1), and the exhaust port 146 of the cylinder head 132B is linked to the exhaust pipe 18B (see FIG. 1).

A pair of intake valves 147 (engine valves) for opening and closing the opening 145A of the intake port 145 and a pair of exhaust valves 148 (engine valves) for opening and closing the opening 146A of the exhaust port 146 are arranged in the cylinder heads 132A and 132B. The intake valves 147 and the exhaust valves 148 are pressed by valve springs 149 and 149 in the directions of closing the pertinent ports. The valve bodies 147 and 148 are driven by valve gears 50 the valve operating characteristics of which, including the timing of opening or closing and the lift, are variable. A valve gear 50 is provided with intake side and exhaust side camshafts 151 and 152 (camshafts) which are turnably supported by the cylinder heads 132A and 132B and turn in synchronism with the revolution of the engine 17.

An intake cam 153 (drive cam) is formed in a solid body with the camshaft 151. The intake cam 153 is provided with a base round part 153A (cam surface) forming a round cam surface and a cam crest part 153B (cam surface) which protrudes from the base round part 153A toward the outer circumference and forms a crest-shaped cam surface. Further; an exhaust cam 154 (drive cam) is formed in a solid body within the camshaft 152. The exhaust cam 154 is provided with a base round part 154A forming a round cam surface and a cam crest part 154B which protrudes from the base round part 154A toward the outer circumference and forms a crest-shaped cam surface.

As shown in FIG. 2, at one end in the widthwise direction of each of the cylinder heads 132A and 132B, an intermediate shaft 158 is turnably supported, and intermediate sprockets 159 and 160 are fixed to this intermediate shaft 158. At one end of the camshaft 151 a driven sprocket 161 is fixed, at one end of the camshaft 152 a driven sprocket 162 is fixed, and at each end of the crankshaft 105 a driving sprocket 163 is fixed. Between these sprockets 159 and 163, a first cam chain 164 is wound, and between the sprockets 160 through 162, a second cam chain 165 is wound. These sprockets 159 through 163 and the cam chains 164 and 165 are housed in a cam chain chamber 166 formed toward one or the other of the banks 110A and 110B.

The reduction ratio from the driving sprockets 163 to driven sprockets 161 and 162 is set to 2; when the crankshaft 105 turns, the driving sprockets 163 turn integrally with the crankshaft 105, the driven sprockets 161 and 162 are turned by cam chains 164 and 165 at a speed half that of the crankshaft 105; and the intake valve 147 and the exhaust valve 148, in accordance with the cam profiles of the camshafts 151 and 152 that turn integrally with the driven sprockets 161 and 162, cause the intake port 145 and the exhaust port 146 to be opened or closed.

A generator not shown is disposed at the left end of the crankshaft 105, and at the right end of the crankshaft 105 a driving gear (hereinafter referred to as the crank side driving gear) 175 is fixed inside the driving sprockets 163 (on the left side of the body). This crank side driving gear 175 meshes with a driven gear (hereinafter referred to as the intermediate side driven gear) 177 disposed on the intermediate shaft 121, and transmits the revolution of the crankshaft 105 to the intermediate shaft 121 at an equal speed and thereby turns the intermediate shaft 121 at an equal speed and in the reverse direction to the crankshaft 105.

The intermediate shaft 121 is supported downward behind the crankshaft 105 and to be turnable downward in front of the main shaft 123.

At the right end of this intermediate shaft 121, an oil pump driving sprocket 181, the intermediate side driven gear 177 and a driving gear (hereinafter referred to as the intermediate side driving gear) 182 smaller in diameter than this driven gear 177 are fitted in this order.

The oil pump driving sprocket 181 transmits the rotational force of the intermediate shaft 121 via a transmission chain 187 to a driven sprocket 186 fixed to the drive axle 185 of an oil pump 184 arranged behind the intermediate shaft 121 and underneath the main shaft 123, and thereby drives the oil pump 184.

Further, the intermediate side driving gear 182 meshes with a driven gear (hereinafter referred to as the main side driven gear) 191 disposed to be turnable relative to the main shaft 123, and transmits reduced revolution of the intermediate shaft 121 via a clutch mechanism (not shown) to the main shaft 123. Thus, the reduction ratio from the crankshaft 105 to the main shaft 123, namely the primary reduction ratio of the engine 17, is set by the reduction ratio between the intermediate side driving gear 182 and the main side driven gear 191.

The main shaft 123 is supported turnably upward behind the crankshaft 105, and the counter shaft 125 is turnably supported substantially behind the main shaft 123. A reduction gear train not shown is arranged astride the main shaft 123 and the counter shaft 125, and these elements constitute a reduction gear system.

The left end of the counter shaft 125 is linked to a drive shaft (not shown) extending in the longitudinal direction of the body. The revolution of the counter shaft 125 is thereby transmitted to the drive shaft.

Figure 4:
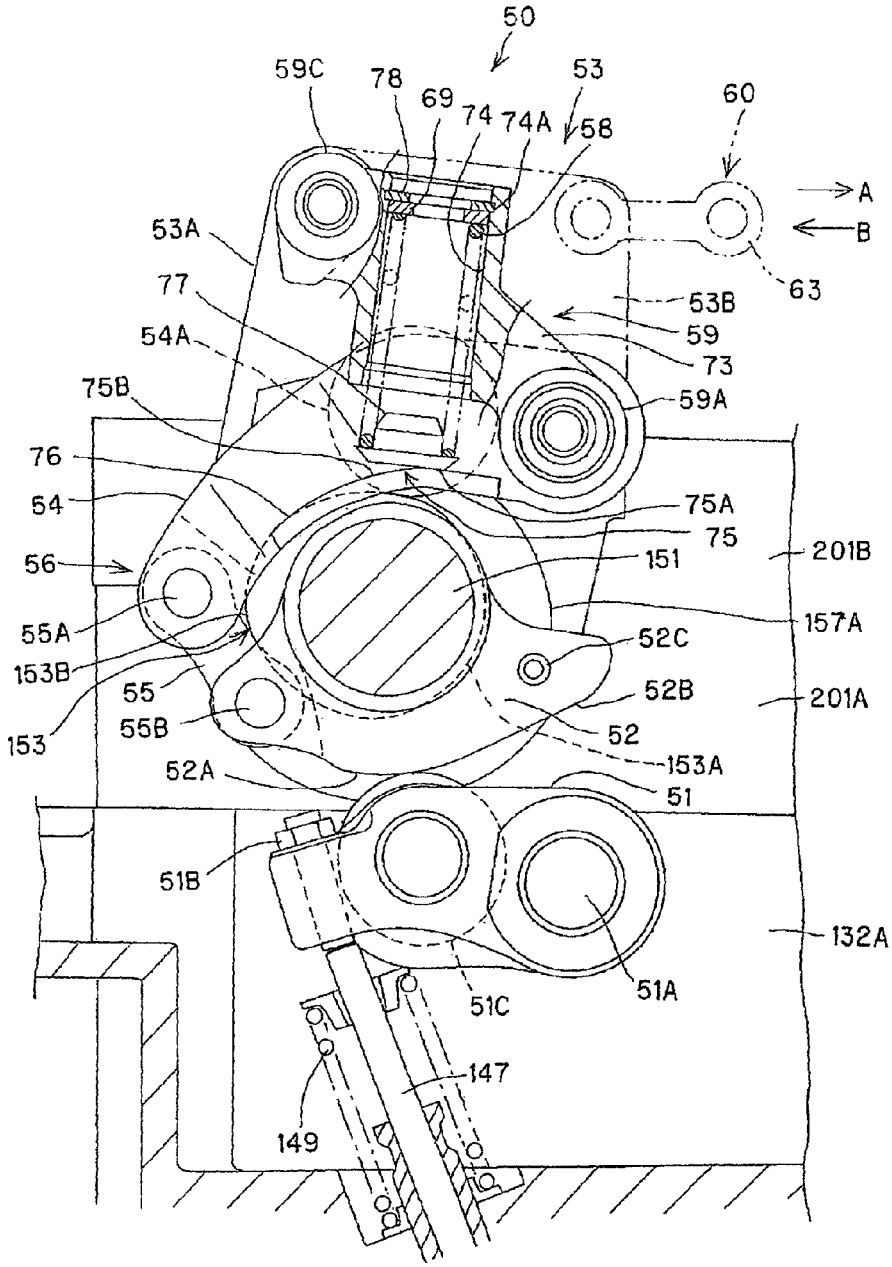
FIGS. 4 and 4A show partially exploded profiles of the valve gear.
Figure 5:
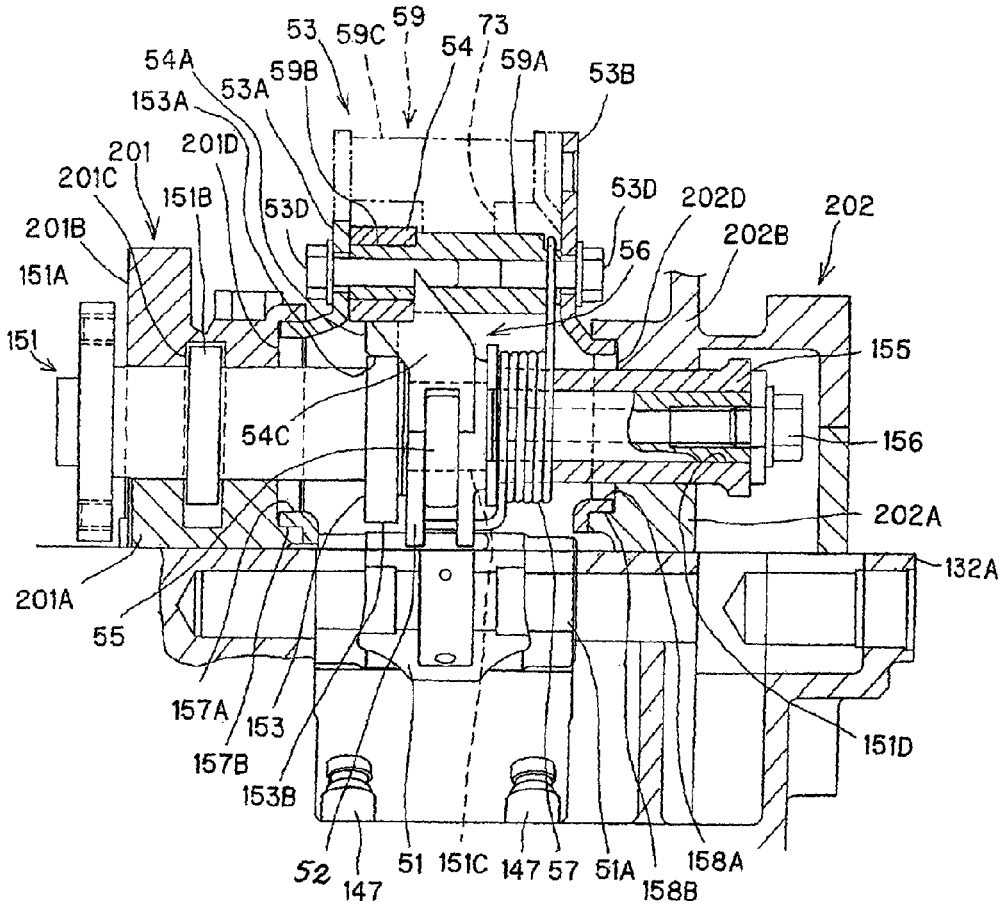
FIGS. 5 and 5A are vertical sections of the valve gear of the front bank as viewed from the rear.
Figure 6:
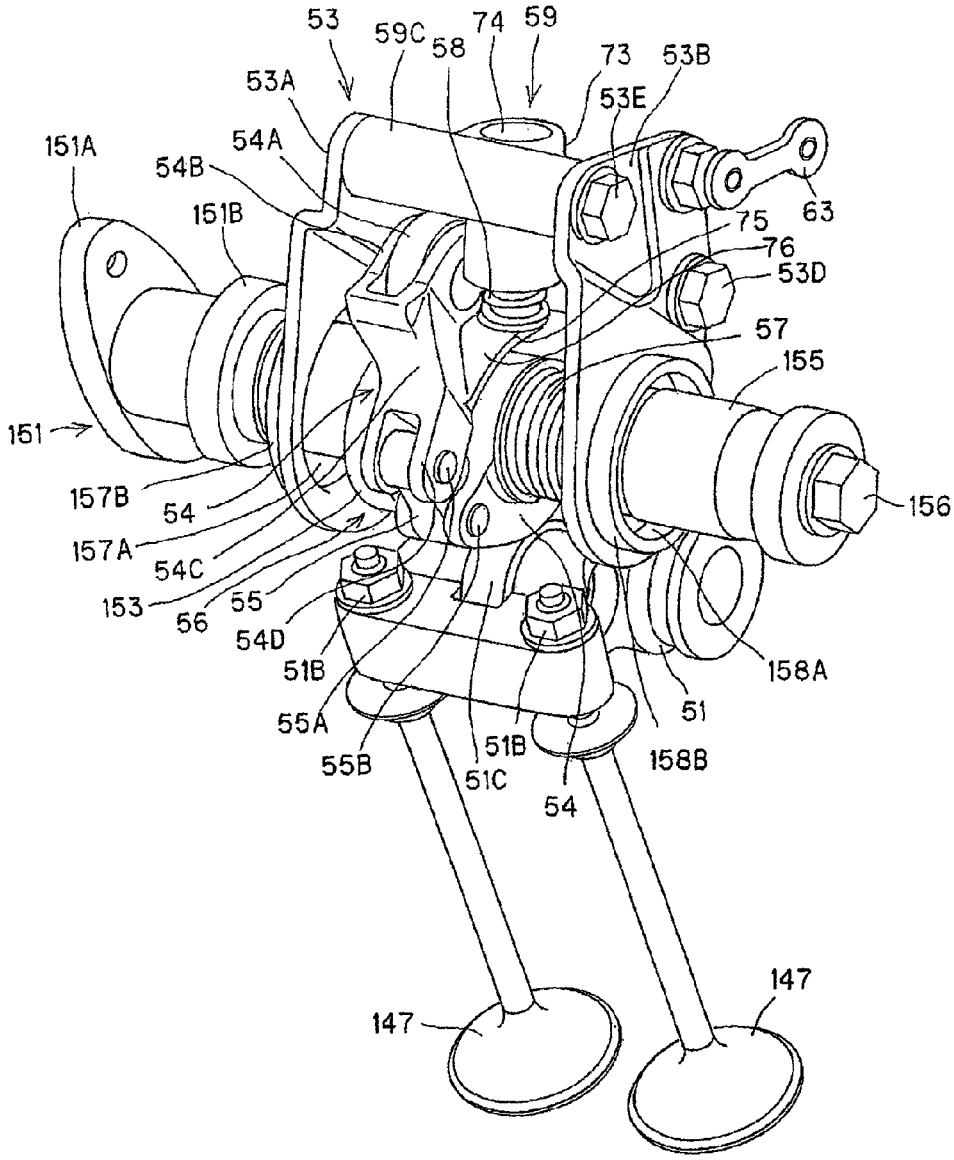
FIG. 6 shows a perspective view of the valve gear shown in FIG. 4.

FIG. 4 shows a partially exploded profile of a valve gear 50, and FIG. 5 is a vertical section of the valve gear 50 of the front bank 110A as viewed from the rear. FIG. 6 shows a perspective view of the valve gear 50.

The valve gears 50, as shown in FIG. 3, are symmetrically disposed, separated between the intake side and the exhaust side around the cylinder axis C. As the valve gear 50 of the front bank 110A and that of the rear bank 110B are structured in substantially the same way, the valve gear 50 on the intake side of the front bank 110A will be described as regards this exemplary embodiment.

The valve gears 50, as shown in FIG. 4 to FIG. 6, are provided with the camshaft 151 (the camshaft 152 on the exhaust side), the intake cam 153 (the exhaust cam 154 on the exhaust side) turning integrally with the camshaft 151, a rocker arm 51 to open and close the intake valve 147 (the exhaust valve 148 on the exhaust side), a valve cam 52 supported by the camshaft 151 to be capable of turning relative thereto and to open and close the intake valve 147 via the rocker arm 51, a holder 53 (holder member) oscillable around the camshaft 151, a link mechanism 56 oscillably supported by the holder 53 to transmit the valve driving force of the intake cam 153 to the valve cam 52 to oscillate the valve cam 52, and a driving mechanism 60 to oscillate the holder 53. Further, the link mechanism 56 is provided with a sub-rocker arm 54 to be linked to the holder 53 and a connecting link 55 to link the sub-rocker arm 54 and the valve cam 52 oscillably.

The rocker arm 51 is formed in a large width, and opens and closes a pair of intake valves 147 with a single rocker arm 51. The rocker arm 51 is oscillably supported at one end by a rocker arm pivot 51A fixed to the cylinder head 132A. At the other end of the rocker arm 51, a pair of adjusting screws 51B are disposed in contact with the upper ends of the intake valves 147, and in the central part of the same, a roller 51C in contact with the valve cam 52 is turnably supported.

As shown in FIG. 5 and FIG. 6, the camshaft 151 has toward one end a sprocket fixing part 151A to which the driven sprocket 161 (see FIG. 2) is fixed, and a positioning part 151B protruding toward the outer circumference of the camshaft 151 and having a round sectional shape, the intake cam 153, an oscillating cam support 151C for oscillably supporting the intake cam 153 and the valve cam 52, and a collar snap-on part 151D formed smaller in diameter than the valve cam support 151C are disposed in this order away from the sprocket fixing part 151A. A camshaft collar 155 that functions as a bearing of the camshaft 151 is snapped onto the collar snap-on part 151D, and the camshaft collar 155 is pressed toward the valve cam 52 by fixing bolts 156, fastened onto the other end of the camshaft 151, and thereby fixed to the camshaft 151.

The two ends of the camshaft 151 are turnably supported by camshaft supports 201 and 202, respectively. In further detail, the camshaft supports 201 and 202 are configured by fixing caps 201B and 202B having semicircular-sectioned supports to head side supports 201A and 202A formed at the top of the cylinder head 132A. In the camshaft support 201 disposed on the positioning part 151B side, a groove 201C so shaped as to match the positioning part 151B is formed, and the camshaft 151 is positioned in the axial direction as the positioning of the positioning part 151B is regulated by the groove 201C.

Further, holder supports 201D and 202D to support the holder 53 are disposed on the respective intake cam 153 side faces of the camshaft supports 201 and 202.

The valve cam 52 is arranged on an oscillating cam support 151C provided on the intermediate part of the camshaft 151. In the valve cam 52, as shown in FIG. 4, a base round part 52A that keeps the intake valve 147 in a closed state and a cam crest part 52B that presses down and opens the intake valve 147 are formed, and a through hole 52C is formed in the cam crest part 52B. To the through hole 52C, one end of a valve cam return spring 57 (see FIG. 5) that presses the valve Cam 52 in the direction for the cam crest part 52B to move away from the roller 51C of the rocker arm 51, namely the direction of closing the intake valve 147, is fitted. The valve cam return spring 57, as shown in FIG. 5, is wound around the cam shaft 151, and its other end is fitted to the holder 53.

The holder 53 is provided with first and second plates 53A and 53B (holder plates), arranged at an prescribed interval in the axial direction of the camshaft 151 with the intake cam 153 and the valve cam 52 in-between, and a coupling member 59 that links the first and second plates 53A and 53B in the axial direction of the camshaft 151. The first plate 53A is arranged toward one end, where the driven sprocket 161 of the camshaft 151 is fixed, and the second plate 53B is arranged toward the other end of the camshaft 151.

Further, the coupling member 59 has a shaft part 59A parallel to the camshaft 151, and at the first plate 53A side end of the shaft part 59A a sub-rocker arm support 59B (supporting shaft) to which one end of the sub-rocker arm 54 is linked is formed. The coupling member 59 is fixed to the first and second plates 53A and 53B by a pair of bolts 53D inserted into the two ends of the shaft part 59A from the outer surface sides of the first and second plates 53A and 53B. Also, the coupling member 59, as shown in FIG. 4, is provided with a shaft part 59C parallel to the shaft part 59A, and is fixed to the first and second plates 53A and 53B by a pair of bolts 53E (see FIG. 6) inserted into the two ends of this shaft part 59C from the outer surface sides of the first and second plates 53A and 53B.

Further, the first and second plates 53A and 53B, as shown in FIG. 5, respectively have shaft holes 157A and 158A which the camshaft 151 penetrates, and the peripheral parts of these shaft holes 157A and 158A constitute annular convexes 157B and 158B protruding toward the holder supports 201D and 202D. The holder 53, supported by the snapping of the convexes 157B and 158B onto the holder supports 201D and 202D, is oscillable centering on the camshaft 151.

The sub-rocker arm 54, arranged together with the intake cam 153 and the valve cam 52 between the first and second plates 53A and 53B, is turnably supported at one end by the sub-rocker arm support 59B of the coupling member 59 to be oscillable centering on the sub-rocker arm support 59B. A roller 54A (pressing part) that comes into contact with the intake cam 153 and presses its cam surface is turnably supported by the central part of the sub-rocker arm 54. To the other end of the sub-rocker arm 54, one end of a connecting link 55 is linked via a pin 55A that oscillably supports the connecting link 55, and to the other end of the connecting link 55 the valve cam 52 is connected via a pin 55B that oscillably supports the valve cam 52.

Further, the sub-rocker atm 54 is pressed by a sub-rocker arm return spring 58 (hereinafter referred to as the return spring) housed in the coupling member 59, and the roller 54A of the sub-rocker arm 54 is pressed against the intake cam 153 all the time. The return spring 58 here is a coil spring.

Next, the operation will be described.

With reference to FIG. 4, when the camshaft 151 is turned in the valve gear 50 configured as described above, the cam crest part 153B of the intake cam 153 turning integrally with the camshaft 151 causes the sub-rocker arm 54 to be pushed up via the roller 54A and to oscillate centering on the shaft part 59A, and along with this the valve cam 52 is caused via the connecting link 55 to turn around the camshaft 151 clockwise as expressed in FIG. 4. And the rotation of the valve cam 52 causes the cam crest part 52B to press down the intake valve 147 together with the rocker arm 51 via the roller 51C thereby to open the intake valve 147. In a state in which the camshaft 151 is further turned to bring the base round part 153A of the intake cam 153 into contact with the roller 54A, the sub-rocker arm 54 is pressed down by the sub-rocker arm return spring 58 and at the same time the valve cam 52 is caused by the valve cam return spring 57 to turn counterclockwise as expressed in FIG. 4 and the base round part 52A comes into contact with the roller 51C. This causes the intake valve 147 to be pushed up by the valve spring 149 (see FIG. 2) and to be closed.

In this valve gear 50, as shown in FIG. 4, a coupling link member 63 is connected to the holder 53. When this coupling link member 63 is shifted in the direction of arrow A, the holder 53 oscillates in the clockwise direction around the axial core of the intake side camshaft 151, and the sub-rocker aim support 59B is displaced downward as expressed in the drawing, or when it is shifted in the direction of arrow B, the holder 53 oscillates in the counterclockwise direction around the axial core of the intake side camshaft 151, and the sub-rocker arm support 59B is displaced upward as expressed in the drawing.

The valve gear 50 is so configured as to be thereby enabled to alter the opening/closing characteristics of the intake valve 147 and the exhaust valve 148.

Figure 7:
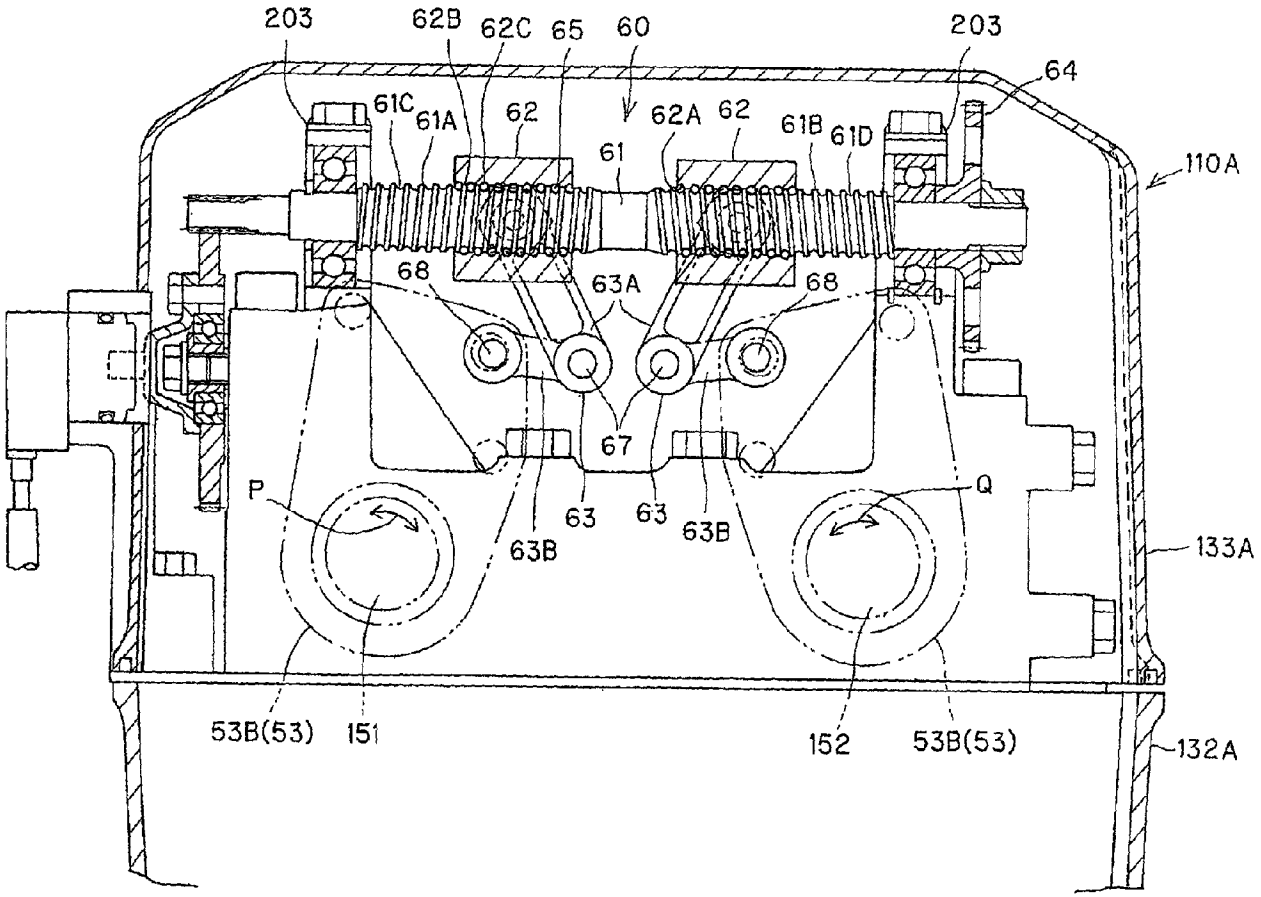
FIG. 7 shows a vertical section of the driving mechanism as viewed from a flank.
Figure 8:
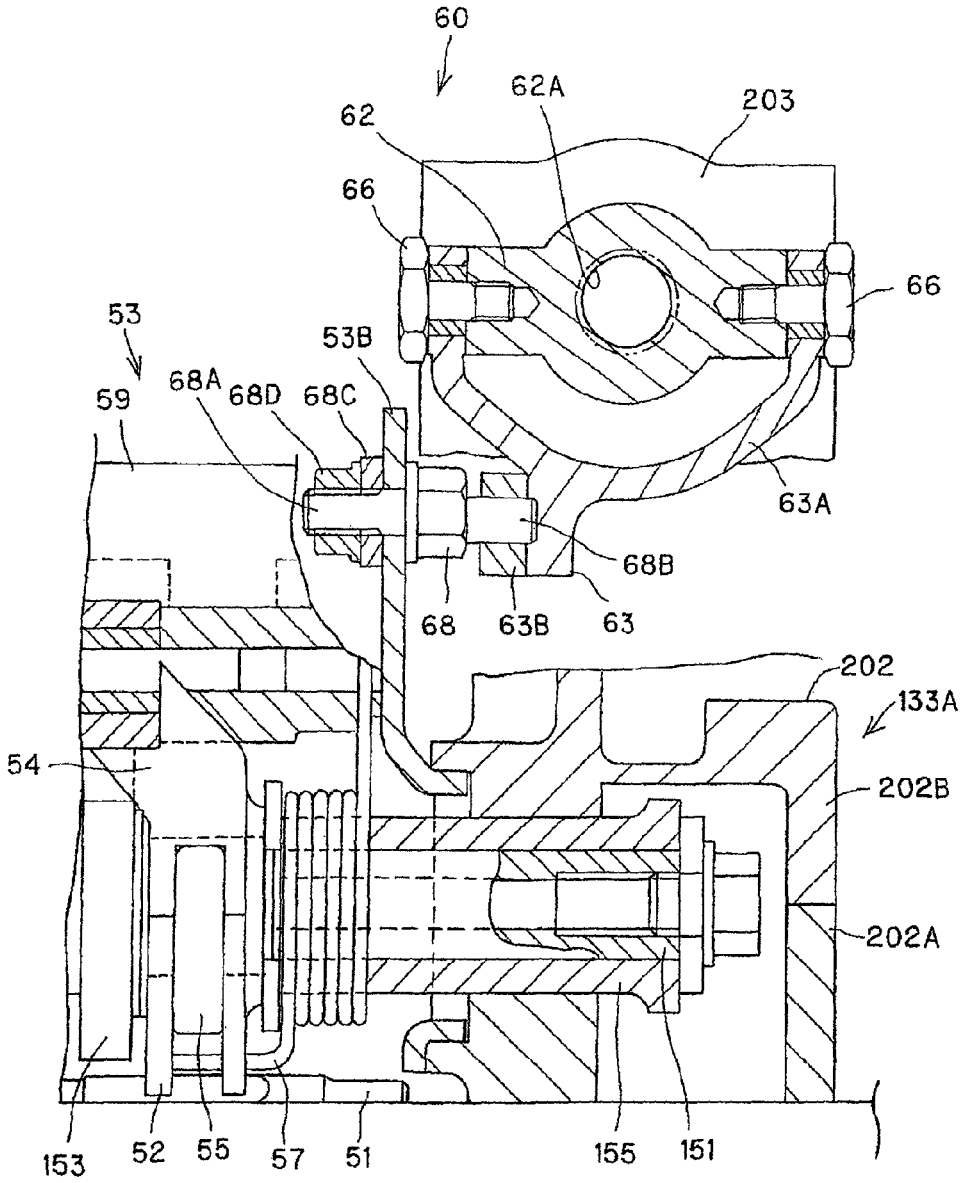
FIG. 8 shows a vertical section of the driving mechanism as viewed from the front.

FIG. 7 shows a profile of a vertical section of the driving mechanism 60, and FIG. 8, a front view of a vertical section of the driving mechanism 60.

The driving mechanism 60, as shown in FIG. 7, is linked to the holder 53 via the coupling link members 63. The driving mechanism 60 is provided with a ball screw 61 arranged astride between the intake side camshaft 151 and the exhaust side camshaft 152 and two nuts 62, capable of shifting in the axial direction on the ball screw 61, one each disposed on the intake and exhaust sides, and the coupling link members 63 are provided between the nuts 62 and the holder 53.

A gear 64 is fastened to one end of the ball screw 61, and an electric actuator not shown is linked to the gear 64 by a gear train wheel.

The ball screw 61 orthogonally crosses the camshafts 151 and 152, and is arranged on the other end sides of these camshafts 151 and 152, namely the other side than that where the driven sprockets 161 and 162 are fixed. As the ball screw 61, instead of extending upward and downward from the engine 17, is arranged astride between the intake side camshaft 151 and the exhaust side camshaft 152 in this way, the height of the engine 17 can be kept relatively low. The two ends of the ball screw 61, as shown in FIG. 6, are supported by one or the other of ball screw supports 203 disposed in the upper part of the cylinder head 132A, and are kept turnable.

As shown in FIG. 7, spiral screw threads 61A and 61B and spiral shaft screw grooves 61C and 61D are formed on the outer circumferential surface of the ball screw 61 respectively on the intake side and the exhaust side. The spiral directions of these screw threads 61A and 61B and the shaft screw grooves 61C and 61D differ between the intake side and the exhaust side.

Each of the nuts 62 has a through hole 62A to let the ball screw 61 penetrate, and on the inner circumferential surface of the through hole 62A a spiral nut thread 62B matching the screw threads 61A and 61B and a spiral nut screw groove 62C matching the shaft screw grooves 61C and 61D are formed. Multiple rollable balls 65 are arranged between these nut screw groove 62C and the shaft screw groove 61C and 61D. The turning of the ball screw 61 causes the nuts 62 via the balls 65 to shift on the ball screw 61.

The coupling link members 63, as shown in FIG. 7 and FIG. 8, are each provided with a nut side link 63A of which one end is fixed to the nuts 62 and a holder side link 63B which links the other end of the nut side link 63A and the second plate 53B.

One end each of the nut side links 63A holds the nuts 62 from two sides and is fixed to the nuts 62 by bolts 66. The other end each of the nut side links 63A is supported oscillably by pins 67 at one end of the holder side link 63B. The other end each of the holder side link 63B is supported oscillably by eccentric pins 68 on the second plate 53B. The eccentric pins 68 are each provided with a hexagon bolt 68A and an eccentric shaft 68B formed eccentrically at and integrally with the head of the hexagon bolt 68A. The hexagon bolt 68A is fixed to the second plate 53B by a spring washer 68C and a hexagon nut 68D, and the eccentric shaft 68B is turnably supported by the nut side link 63A.

Referring to FIG. 7, when the holder 53 oscillates in the directions of arrows P and Q, the position of the sub-rocker arm support 59B of the link mechanism 56 shown in FIG. 4 is varied. The variation of the position of the sub-rocker arm support 59B causes the valve cam 52 to oscillate centering on the camshaft 151, its position is displaced in the circumferential direction relative to the camshaft 151, and its phase in the circumferential direction relative to the intake cam 153, the angular position or the position in the circumferential direction here, is varied. As the duration of the contact of the cam crest part 52B of the valve cam 52 with the roller 51C and the extent of its being pressed down can be altered by varying the position of the valve cam 52 in the circumferential direction relative to the intake cam 153 in this way, the duration of the opening and the lift of the intake valve 147 can be varied.

For instance, when the ball screw 61 turns to shift the nuts 62 toward the center of the ball screw 61 and the holder 53 is further oscillated by the coupling link member 63 in the clockwise direction as expressed in FIG. 4, the valve cam 52 is turned by the link mechanism 56 in the clockwise direction; when the camshaft 151 is turned in this state, the duration and extent of the pressing-down of the roller 51C by the cam crest part 52B are increased, and the duration of the opening and the lift of the intake valve 147 are increased.

Figure 9:
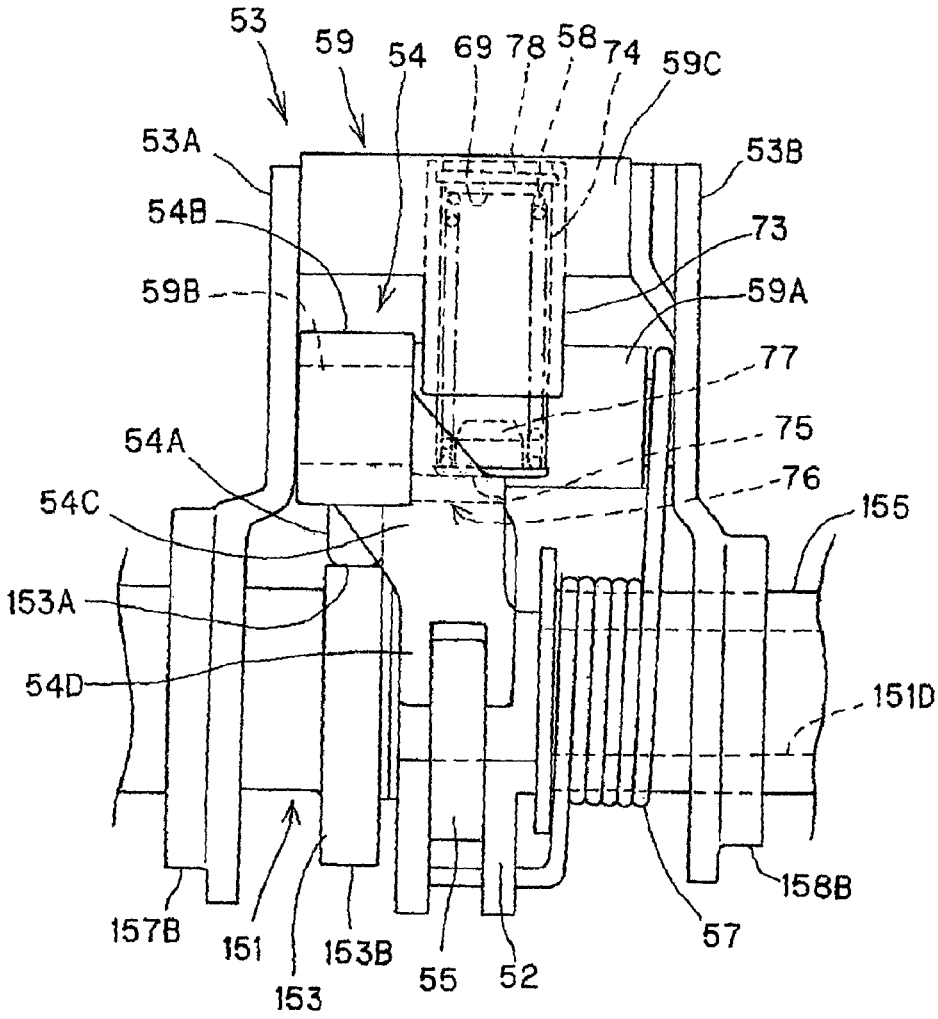
FIG. 9 shows a front view of the essential part of the valve gear of the front bank as viewed from the rear.
Figure 10:
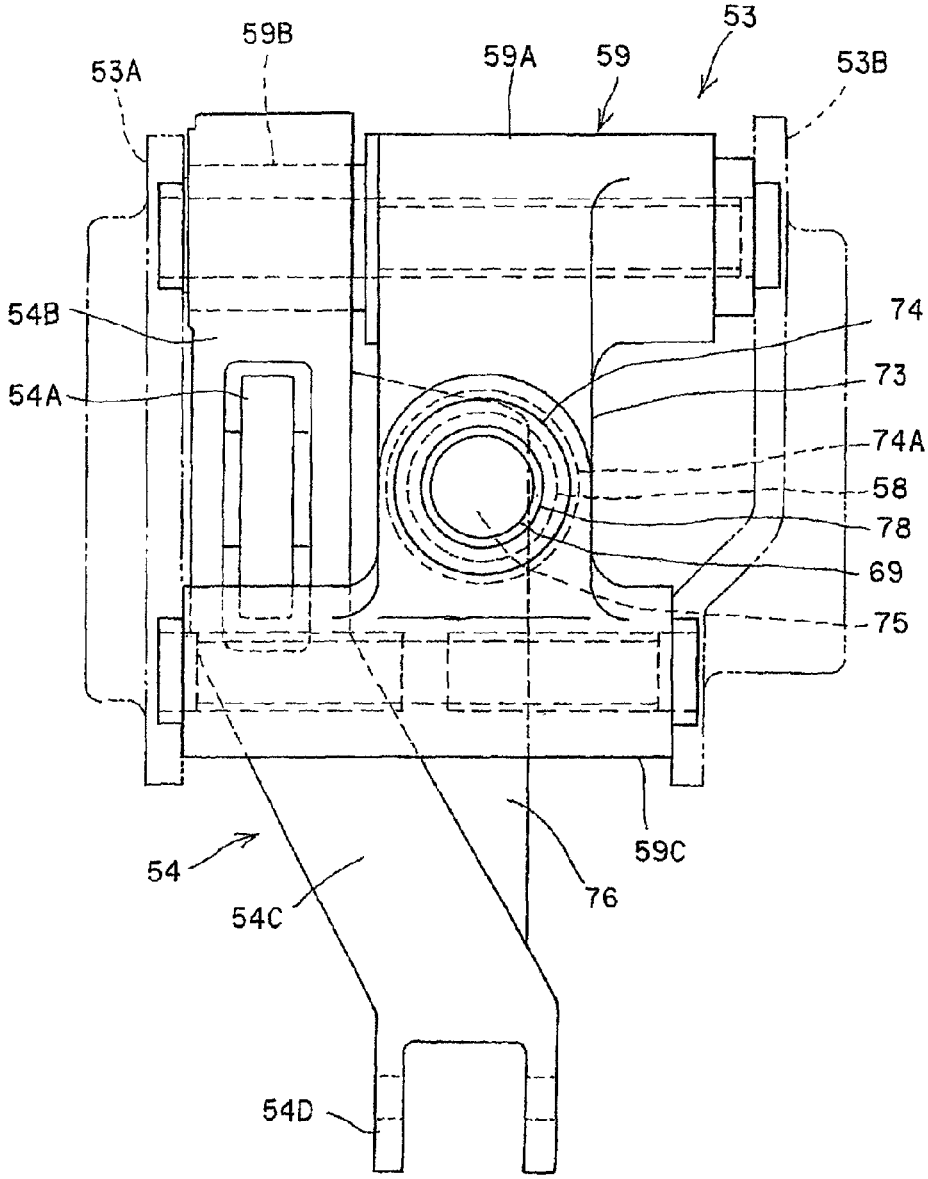
FIG. 10 is a plan of the vicinities of the holder 53 of FIG. 4 as seen from above.

FIG. 9 shows a front view of the essential part of the valve gear 50 of the front bank 110A as seen from behind. FIG. 10 is a plan of the vicinities of the holder 53 as seen from above.

As shown in FIGS. 9 and 10, the coupling member 59 of the holder 53 links the upper parts of the first and second plates 53A and 53B to each other. The coupling member 59 has a joining part 73 that links and joins the shaft part 59A and the shaft part 59C positioned higher than the shaft part 59A. The joining part 73 is positioned in the middle part of the interval between the first plate 53A and the second plate 53B.

As shown in FIG. 4, FIG. 6 and FIG. 9, the coupling member 59 is disposed above the camshaft 151, and the joining part 73 of the coupling member 59 is provided with a spring receptacle 74 (through hole) penetrating the joining part 73 in the vertical direction of the vehicle. The spring receptacle 74 is a round through hole positioned above the camshaft 151, and accommodates the sub-rocker arm return return spring 58 inside.

A circlip engaging groove 74A is formed in the upper part of the spring receptacle 74 by so denting as to make a full round of the inner circumferential part of the spring receptacle 74. A circlip 78 that bears the upper end of the return spring 58 is engaged with the circlip engaging groove 74A. A washer 69 is disposed intervening between the circlip 78 and the upper end of the sub-rocker arm return return spring 58.

The sub-rocker arm 54 has a holder linking part 54B linked to the sub-rocker arm support 59B and so extending as to orthogonally cross the camshaft 151, an eccentric part 54C so bending from the holder linking part 54B as to go along the outer diameter of the camshaft 151, and a link section 54D that is linked to the valve cam 52 via the connecting link 55.

The holder linking part 54B, disposed between the first plate 53A and the joining part 73, is positioned immediately above the cam surface of the intake cam 153. The roller 54A in contact with the cam surface is disposed on the holder linking part 54B.

The eccentric part 54C so becomes eccentric in the axial direction of the camshaft 151 from the first plate 53A side toward the second plate 53B side as to keep away from the intake cam 153, and a tabular step 76 protruding in the axial direction of the camshaft 151 is formed on a flank of this eccentric part 54C. As shown in FIG. 4 and FIG. 6, the step 76 is disposed bending along the bottom line of the sub-rocker arm 54. Further the step 76, as shown in FIG. 10, is compactly formed in a smaller width than the eccentric part 54C not to affect the maximum width of the sub-rocker arm 54.

The link section 54D is formed at one end of and continuously from the eccentric part 54C and linked to the valve cam 52. In this way, the sub-rocker arm 54 links the intake cam 153 and the valve cam 52, disposed in different positions in the axial direction on the camshaft 151, by the eccentricity of the eccentric part 54C.

The sub-rocker arm return return spring 58 is inserted into and held by the spring receptacle 74 of the coupling member 59, and so accommodated that the axis of the return spring 58 is in the vertical direction of the vehicle. The lower end of the spring receptacle 74 extends to a lower level than the upper surface of the sub-rocker arm 54, and a great enough guide length of the return spring 58 is thereby secured.

The step 76 is formed overlying the joining part 73 and the spring receptacle 74 in a plane view, and the step 76 positioned underneath the spring receptacle 74 functions as a spring socket 75 that bears the lower end of the return spring 58.

At the lower end of the sub-rocker arm return return spring 58, a spring washer 77 that snaps into the bore of the return spring 58 is provided, and the spring socket 75 bears the return spring 58 via the spring washer 77. As shown in FIG. 4, in a state in which the base round part 153A of the intake cam 153 is in contact with the roller 54A, the spring washer 77 is in contact with the parallel part 75A of the spring socket 75 in a substantially half of its round contact part toward the shaft part 59A. And, referring to FIG. 4, when the intake cam 153 turns, the cam crest part 153B comes into contact with the roller 54A and the sub-rocker arm 54 oscillates upward, the curved part 75B of the spring socket 75 oscillates upward centering on the sub-rocker arm support 59B, and compresses the return spring 58 while varying the point of contact with the contact part of the spring washer 77. In a situation in which the sub-rocker arm 54 oscillates centering on the sub-rocker arm support 59B, as the curved part 75B thrusts up the spring washer 77, the return spring 58 can achieve flexure substantially perpendicularly without being bent, and the return spring 58 can be extended or contracted stably.

Further as shown in FIG. 4, the axis of the sub-rocker arm return return spring 58 in a side view overlies the center of the camshaft 151, is disposed orthogonally crossing the camshaft 151 from above the camshaft 151, and arranged compactly in the longitudinal direction of the vehicle. Further, as the return spring 58, with its axis overlying the center of the roller 54A, is disposed adjoining the roller 54A in a plane view as shown in FIG. 10, it can press the roller 54A via the vicinities of the roller 54A, and can effectively press the roller 54A against the intake cam 153.

Moreover, as the spring receptacle 74 is so disposed adjoining the holder linking part 54B as to keep away from the sub-rocker arm 54 and the return spring 58 is held by the spring socket 75 formed on the lower edge of the sub-rocker arm 54 and the circlip 78 above the holder 53, a sufficient overall length of the spring receptacle 74 can be secured. As this enables the return spring 58 to have a sufficient overall length, the freedom of designing can be enhanced.

Furthermore, the spring socket 75 is disposed by utilizing the shape of the sub-rocker arm 54 that is eccentric in the axial direction, there is no need to increase the size of the sub-rocker arm 54 in the widthwise direction to provide the spring socket 75, making it possible to give the valve gear 50 a compact configuration.

And when the sub-rocker arm return return spring 58 is to be assembled in, the return spring 58 fitted with the spring washer 77 is inserted into the spring receptacle 74 from above the spring receptacle 74, after that the washer 69 can be arranged at the upper end and the circlip 78 can be engaged into the circlip engaging groove 74A. Since the return spring 58 is fitted from above the coupling member 59 in this way, the return spring 58 can be fitted after the link mechanism 56 and the valve cam 52 are fitted to the holder 53, and no work against the spring force of the return spring 58 is needed while fitting the holder 53, the link mechanism 56 and the valve cam 52. As a result, the assembling ease of the valve gear 50 can be enhanced.

As hitherto described with reference to FIGS. 4-6, since the spring socket 75 of the return spring 58 of the sub-rocker arm is provided in the step 76 disposed by arranging the sub-rocker arm 54 eccentrically in the axial direction of the camshaft 151 and the return spring 58 is supported in the vertical direction of the vehicle between the spring socket 75 and the holder 53 positioned above the spring socket 75, the length occupied by the return spring 58 (FIG. 4) in the longitudinal direction of the vehicle can be reduced. This enables the return spring 58 (FIG. 4) to be arranged compactly in the longitudinal direction of the vehicle and the longitudinal length of the cylinder head 132A to be shortened.

Further, as the sub-rocker arm return return spring 58 (FIG. 4) is housed in the spring receptacle 74 that runs through in the vertical direction, it is possible to shorten the longitudinal length of the cylinder head 132A by arranging the return spring 58 in the vertical direction of the vehicle and arranging the return spring 58 compactly in the longitudinal direction. Also, as the return spring 58 is disposed in the spring receptacle 74 that penetrates the holder 53 in the vertical direction and the return spring 58 is housed within the holder 53, the return spring 58 can be compactly arranged. Moreover, since the return spring 58 is inserted into and held by the spring receptacle 74, it is possible to insert and fit the return spring 58 after the parts of the valve gear 50 have been assembled, resulting in assembling ease.

Furthermore, as the spring receptacle 74 is disposed in the joining part 73 of the coupling member 59 linking the pair of left and right first and second plates 53A and 53B and accordingly the spring receptacle 74 is positioned in the upper part of the holder 53, the return spring 58 can be easily inserted from above, resulting in assembling ease.

Although the present invention has been described with respect to a configuration in which the spring receptacle 74 penetrates the joining part 73 in the vertical direction by way of example, the invention is not limited to this configuration. For instance, it is possible to dispose the spring receptacle 74, instead of making it a through hole, as a bag-like dead-end hole extending upward from the under surface of the joining part 73, and to have the closed part above bear the upper end of the return spring 58.

Further, although the present invention has been described under the supposition that the engine 17 is a DOHC type engine, the invention is not limited to this type, and the numbers of the camshaft(s) 151, the intake valve(s) 147 and the exhaust valve(s) 148 to be provided per cylinder are not restricted in particular; for instance, the engine may as well be an SOHC type engine. Other detailed configuration of the motorcycle 10 can obviously be altered, too, as desired.

FIGS. 4A, 5A, 11, and 12 illustrate a variation of valve gear 50 as discussed above and as illustrated in FIGS. 4 and 5.

Figure 4A:
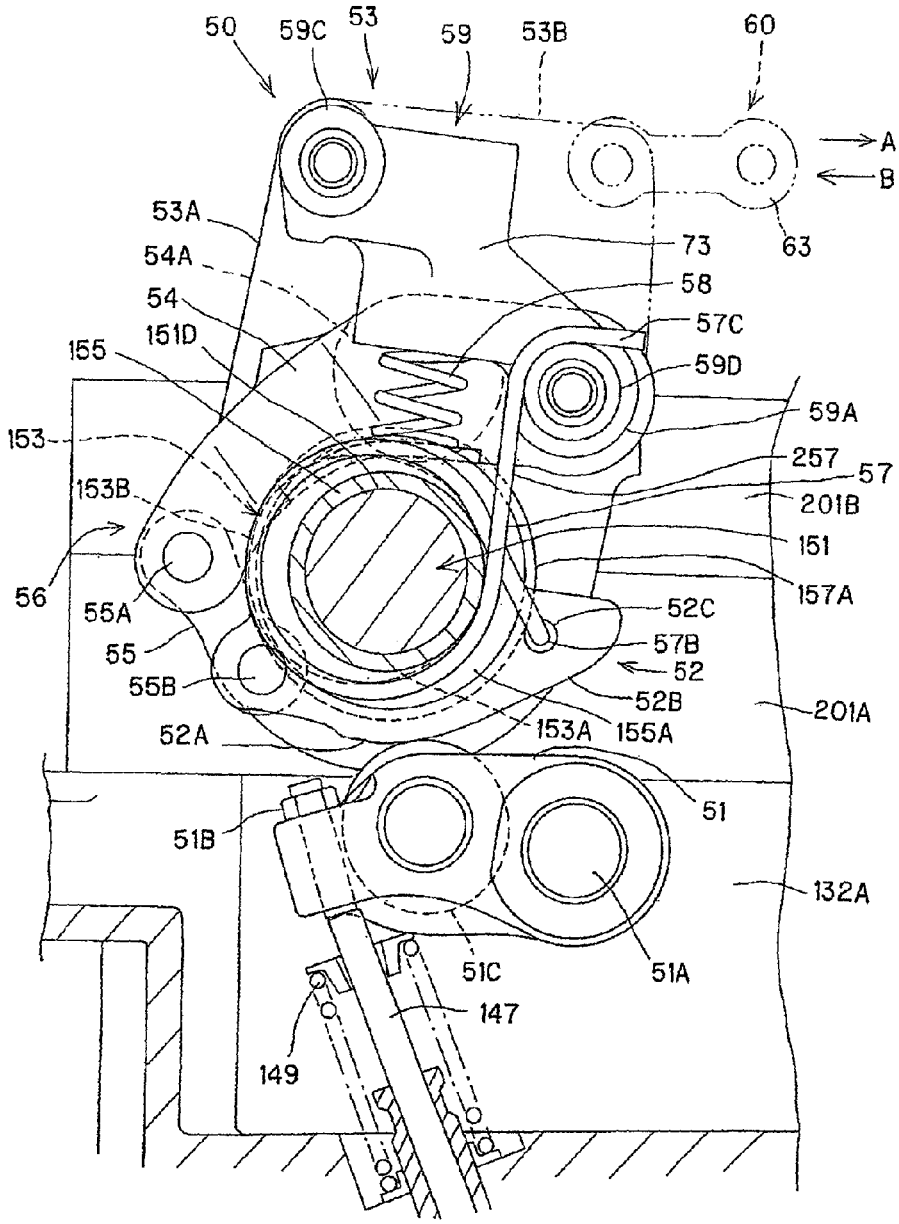
Figure 5A:
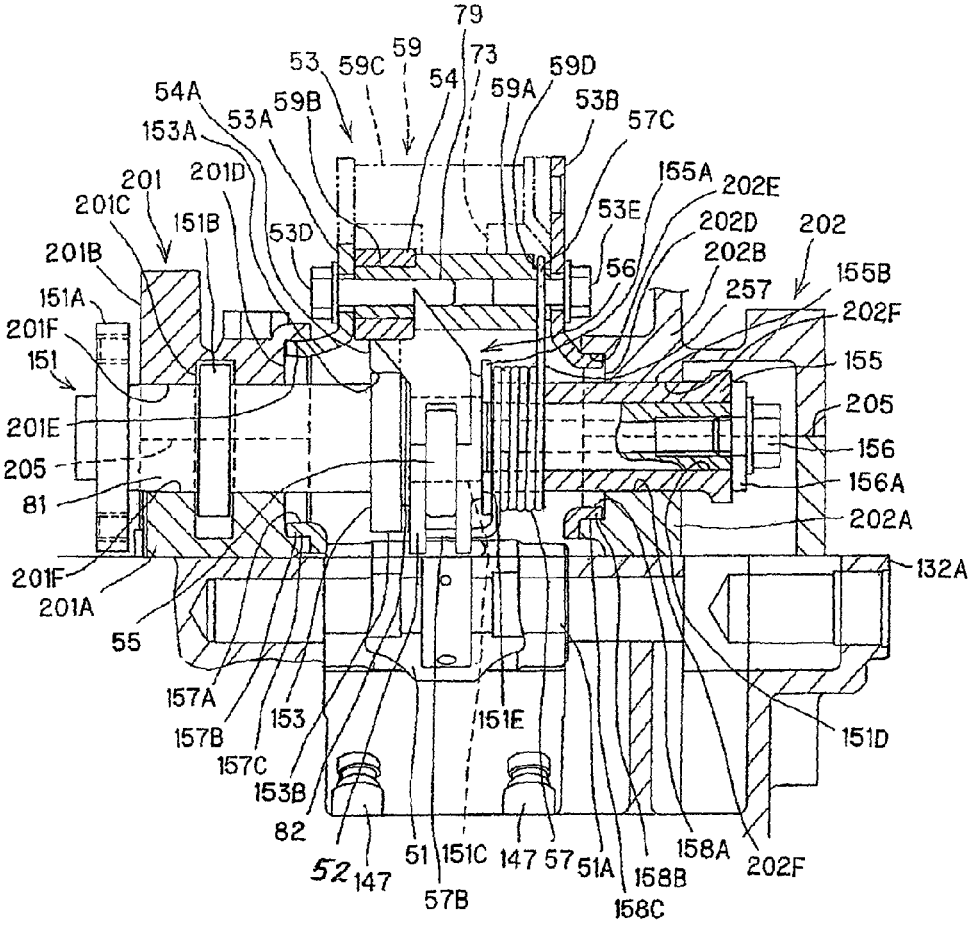

FIG. 4A shows a partially exploded profile of a valve gear 50, and FIG. 5A is a vertical section of the valve gear 50 of the front bank 110A as viewed from the rear.

The valve gears 50, as shown in FIG. 3, are symmetrically disposed, separated between the intake side and the exhaust side around the cylinder axis C. As the valve gear 50 of the front bank 110A and that of the rear bank 110B are structured in substantially the same way, the valve gear 50 on the intake side of the front bank 110A will be described as regards this exemplary embodiment.

The valve gears 50, as shown in FIG. 4A and FIG. 5A, are provided with the camshaft 151 (the camshaft 152 on the exhaust side), the intake cam 153 (the exhaust cam 154 on the exhaust side) turning integrally with the camshaft 151, a rocker arm 51 to open and close the intake valve 147 (the exhaust valve 148 on the exhaust side), a valve cam 52 supported by the camshaft 151 to be capable of turning relative thereto and to open and close the intake valve 147 via the rocker arm 51, a holder 53 oscillable around the camshaft 151, a link mechanism 56 oscillably supported by the holder 53 to transmit the valve driving force of the intake cam 153 to the valve cam 52 to oscillate the valve cam 52, and a driving mechanism 60 to oscillate the holder 53. Further, the link mechanism 56 is provided with a sub-rocker arm 54 to be linked to the holder 53 and a connecting link 55 to link the sub-rocker arm 54 and the valve cam 52 oscillably.

The rocker arm 51 is formed in a large width, and opens and closes a pair of intake valves 147 with a single rocker arm 51. The rocker arm 51 is oscillably supported at one end by a rocker arm pivot 51A fixed to the cylinder head 132A. At the other end of the rocker arm 51, a pair of adjusting screws 51B are disposed in contact with the upper ends of the intake valves 147, and in the central part of the same, a roller 51C in contact with the valve cam 52 is turnably supported.

As shown in FIG. 5A, the camshaft 151 has toward one end a sprocket fixing part 151A to which the driven sprocket 161 (see FIG. 2) is fixed, and a positioning part 151B protruding toward the outer circumference of the camshaft 151 and having a round sectional shape, a valve cam support 151C (a part supporting the valve cam) oscillably supporting the intake cam 153 and the valve cam 52, and a collar snap-on part 151D formed smaller in diameter than the valve cam support 151C are disposed in this order away from the sprocket fixing part 151A. A camshaft collar 155 (cam shaft collar) that functions as a bearing of the camshaft 151 is snapped onto the collar snap-on part 151D, and the camshaft collar 155 is pressed toward the valve cam 52 by fixing bolts 156, fastened onto the other end of the camshaft 151, and thereby fixed to the camshaft 151.

The two ends of the camshaft 151 are turnably supported by camshaft supports 201 and 202, respectively. In further detail, the camshaft supports 201 and 202 are configured by fixing caps 201B and 202B having semicircular-sectioned supports to head side supports 201A and 202A formed at the top of the cylinder head 132A. In the camshaft support 201 disposed on the positioning part 151B side, a groove 201C so shaped as to match the positioning part 151B is formed, and the camshaft 151 is positioned in the axial direction as the positioning of the positioning part 151B is regulated by the groove 201C.

Further, holder supports 201D and 202D to support the holder 53 are disposed on the respective intake cam 153 side faces of the camshaft supports 201 and 202.

The valve cam 52 is arranged adjacent to the intake cam 153 on the valve cam support 151C disposed in the intermediate part of the camshaft 151. In the valve cam 52, as shown in FIG. 4A, a base round part 52A to keep the intake valve 147 in a closed state and a cam crest part 52B that presses down and thereby opens the intake valve 147 are formed, and a supporting hole 52C is formed in the cam crest part 52B. A valve cam return spring 57 (hereinafter referred to as the return spring) is fitted to the valve cam 52. This return spring 57 presses the valve cam 52 in the direction in which the cam crest part 52B moves away from the roller 51C of the rocker arm 51, namely in the direction of closing the intake valve 147.

The holder 53 is provided with first and second plates 53A and 53B (holder plates) arranged at a prescribed interval in the axial direction of the camshaft 151 with the intake cam 153 and the valve cam 52 in-between and a coupling member 59 (sub-rocker arm supporting member) to couple the first and second plates 53A and 53B in the axial direction of the camshaft 151. The first plate 53A is arranged toward one end where the driven sprocket 161 of the camshaft 151 is fixed, and the second plate 53B is arranged toward the other end of the camshaft 151.

The coupling member 59 is provided with shaft parts 59A and 59C parallel to the camshaft 151 and a coupling part 73 that couples the shaft part 59A and the shaft part 59C. The shaft part 59A is positioned lower than the shaft part 59C, and the coupling part 73 is inclined from the shaft part 59C toward the shaft part 59A. Further, the coupling part 73 is positioned in the middle of the interval between the first plate 53A and the second plate 53B.

A sub-rocker arm support 59B (fulcrum) to which one end of the sub-rocker aim 54 is linked is formed at the first plate 53A side end of the shaft part 59A.

These first and second plates 53A and 53B and coupling member 59 are fixed with a pair of bolts 53D which fasten the first plate 53A and the coupling member 59 from the outer surface side of the first plate 53A and a pair of bolts 53E which fasten the second plate 53B and the coupling member 59 from the outer surface side of the second plate 53B. A female thread 79 into which these bolts 53D and 53E are screwed is formed on each of the shaft parts 59A and 59C.

Further, the first and second plates 53A and 53B, as shown in FIG. 5A, respectively have shaft holes 157A and 158A (through holes) penetrated by the camshaft 151, and the peripheries of these shaft holes 157A and 158A constitute annular convexes 157B and 158B protruding toward the holder supports 201D and 202D. The holder 563 is supported by the snapping of the convexes 157B and 158B into the holder supports 201D and 202D, and can oscillate around the camshaft 151.

The sub-rocker arm 54, arranged together with the intake cam 153 and the valve cam 52 between the first and second plates 53A and 53B, is turnably supported at one end by the sub-rocker aim support 59B of the coupling member 59, and oscillates pivoting on the sub-rocker aim support 59B. A roller 54A which comes into contact with the intake cam 153 and presses the cam surface is turnably supported by the central part of the sub-rocker arm 54. One end of the connecting link 55 is connected to the other end of the sub-rocker arm 54 via a pin 55A oscillably supporting the connecting link 55, and to the other end of the connecting link 55 the valve cam 52 is linked via a pin 55B oscillably supporting the valve cam 52.

Further, the sub-rocker arm 54 is pressed by a sub-rocker arm return spring 58 accommodated in a hole formed in the coupling member 59, and the roller 54A of the sub-rocker arm 54 is pressed against the intake cam 153 all the time. The sub-rocker arm return spring 58 here is a cylindrical coil spring.

Next, the operation of the valve gear 50 illustrated in FIGS. 4A, 5A, 11, and 12 will be described.

With reference to FIG. 4A, when the camshaft 151 is turned in the valve gear 50 configured as described above, the cam crest part 153B of the intake cam 153 turning integrally with the camshaft 151 causes the sub-rocker arm 54 to be pushed up via the roller 54A and to oscillate pivoting on the shaft part 59A, and along with this the valve cam 52 is caused via the connecting link 55 to turn around the camshaft 151 clockwise as expressed in FIG. 4A. And the rotation of the valve cam 52 causes the cam crest part 52B to press down the intake valve 147 together with the rocker arm 51 via the roller 51C thereby to open the intake valve 147. In a state in which the camshaft 151 is further turned to bring the base round part 153A of the intake cam 153 into contact with the roller 54A, the sub-rocker arm 54 is pressed down by the sub-rocker arm return spring 58 and at the same time the valve cam 52 is caused by the return spring 57 of the valve cam to turn counterclockwise as expressed in FIG. 4, and the base round part 52A comes into contact with the roller 51C. This causes the intake valve 147 to be pushed up by the valve spring 149 (see FIG. 2) and to be closed.

In this valve gear 50, as shown in FIG. 4A, a coupling link member 63 is connected to the holder 53. When this coupling link member 63 is shifted in the direction of arrow A, the holder 53 oscillates in the clockwise direction around the axial core of the intake side camshaft 151, and the sub-rocker arm support 59B is displaced downward as expressed in the drawing, or when it is shifted in the direction of arrow B, the holder 53 oscillates in the counterclockwise direction around the axial core of the intake side camshaft 151, and the sub-rocker arm support 59B is displaced upward as expressed in the drawing.

The valve gear 50 is so configured as to be thereby enabled to alter the opening/closing characteristics of the intake valve 147 and the exhaust valve 148.

Figure 11:
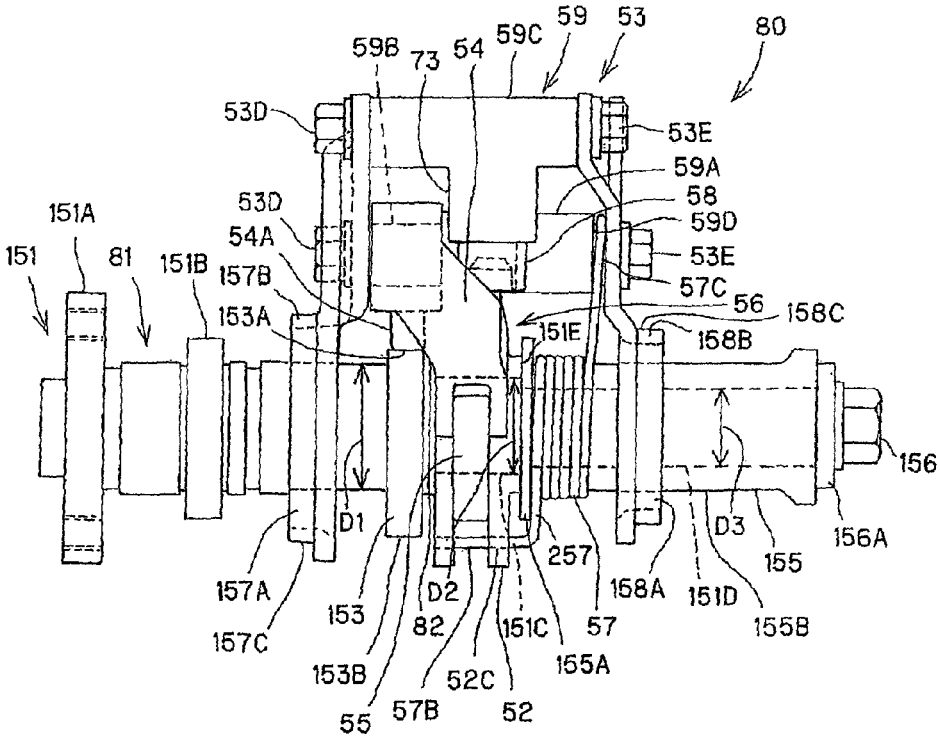
FIG. 11 shows a front view of the essential part of the valve gear shown in FIG. 4A.

FIG. 11 shows a front view of the essential part of the valve gear 50 illustrated in FIG. 4A.

The valve gear 50 is configured by fitting to the cylinder head 132A a camshaft structure 80 formed by incorporating such components as the holder 53 and the valve cam 52 into the camshaft 151. This camshaft structure 80 is provided with the holder 53, the sub-rocker arm 54, the connecting link 55, the valve cam 52, the camshaft collar 155, the sub-rocker arm return spring 58 and the return spring 57 of the valve cam.

The camshaft 151, fabricated through a process involving cutting, grinding and other steps, is configured by forming on a single main shaft 81 the sprocket fixing part 151A, the positioning part 151B, the intake cam 153, the valve cam support 151C and the collar snap-on part 151D integrally. As the camshaft 151 thus has the intake cam 153 formed integrally with it, there is no need to pressure-fit the intake cam 153 into the camshaft 151, and therefore the man-hours required for fabrication can be reduced.

Whereas the main shaft 81 is so formed as to increase in diameter stepwise from the collar snap-on part 151D toward the sprocket fixing part 151A side, the diameter D1 of the main shaft 81 in the part where the intake cam 153 is formed is greater than the diameter D2 of the valve cam support 151C, and the diameter D2 is formed greater than the diameter D3 of the collar snap-on part 151D positioned on the other side of the diameter D1 with the diameter D2 in-between. And when the camshaft structure 80 is to be assembled, components are inserted from the smaller-diameter collar snap-on part 151D side toward the front toward the sprocket fixing part 151A farther inside.

Figure 12:
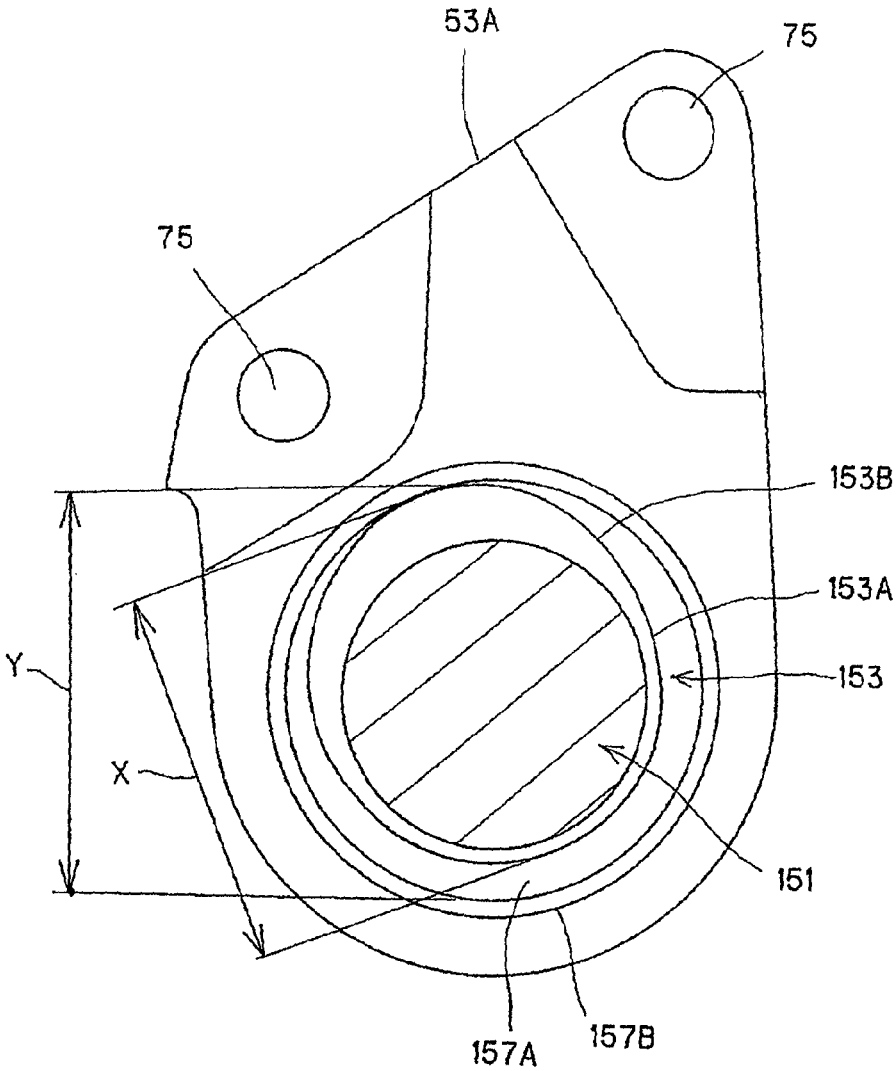
FIG. 12 shows a partially exploded profile of the first holder plate 53A and the camshaft from the sprocket fixing part side.

FIG. 12 shows a partially exploded profile of the first plate 53A and the camshaft 151 from the sprocket fixing part 151A side.

In the upper part of the first plate 53A, there are formed holes 75 through which the bolts 53D which link the first plate 53A to the coupling member 59 are to pass. The shaft holes 157A which the camshaft 151 penetrates are positioned in the lower part of the first plate 53A. The first and second plates 53A and 53B are fabricated by pressing, cutting and other modes of processing, while the diameters of the outer circumferences of the convexes 157B and 158B which are snapped onto the holder supports 201D and 202D to be tamable relative to each other are machined with high precision. Further, the annular convexes 157B and 158B are formed coaxially with the shaft holes 157A and 158A, respectively.

As shown in FIG. 5A, the camshaft supports 201 and 202 are vertically divided into the head side supports 201A and 202A and the caps 201B and 202B, respectively, and the dividing faces 205 which the head side supports 201A and 202A divide the caps 201B and 202B from each other substantially coincide with the axis of the camshaft 151. The head side supports 201A and 202A and the caps 201B and 202B have semicircular concaves 201F and 202F each supporting the camshaft 151.

The holder supports 201D and 202D are configured in an annular shape by the matching of the paired higher and lower semicircular concaves formed on the head side supports 201A and 202A and the caps 201B and 202B by the fitting of the caps 201B and 202B to the head side supports 201A and 202A. The annular holder supports 201D and 202D are so formed as to be coaxial with the camshaft 151 in a state in which the camshaft 151 is fitted to the camshaft supports 201 and 202. Further, the bores of the holder supports 201D and 202D are formed greater than the diameters of the camshaft supports 201 and 202 in the parts where they support the camshaft 151.

As shown in FIG. 12, the bores Y of the shaft holes 157A are formed greater than the maximum outer diameter X of the intake cam 153. The maximum outer diameter X here is the length of a straight line linking the vertex of the cam crest part 153B and that of the base round part 153A past the center of the camshaft 151. As the bores Y of the shaft holes 157A is thus greater than the maximum outer diameter X of the intake cam 153, the first plate 53A inserted into the camshaft 151 can shift on the camshaft 151 in the axial direction past the intake cam 153.

On the other hand, the bores of the shaft holes 157A of the second plate 53B are formed smaller than the maximum outer diameter X, and the second plate 53B is not shifted overriding the intake cam 153. As the second plate 53B is thereby kept from being brought accidentally to a position beyond the intake cam 153, wrong assembling of the second plate 53B can be prevented.

As shown in FIG. 11, the camshaft collar 155 is snapped adjacent to the valve cam 52 onto the collar snap-on part 151D and fixed with the fixing bolts 156. The outer circumferential surface 155B of the camshaft collar 155 is configured as a plain bearing (sliding bearing). The camshaft support 202 (see FIG. 5) turnably supports the camshaft 151 via the outer circumferential surface 155B of the camshaft collar 155, which is a plain bearing.

At the valve cam 52 side end of the camshaft collar 155, a return spring keep flange 155A (hereinafter referred to as the flange) protruding from the outer circumferential surface 155B of the camshaft collar 155 outward in the circumferential direction is formed. This flange 155A is in contact with a step 151E of the valve cam support 151C on the collar snap-on part 151D side and positioned near a side surface of the valve cam 52 to regulate the position of the valve cam 52 in the axial direction. Further, a step 82 formed greater in diameter than the valve cam support 151C is disposed between the intake cam 153 and the valve cam 52, and a flank of the intake cam 153 in the valve cam 52 is in contact with the step 82. Thus, the valve cam 52 is positioned relative to the valve cam support 151C by the step 151E and the step 82.

The return spring 57 of the valve cam is a torsion coil spring formed by coiling a wire rod 257, and has a cylindrical bore part 57A (see FIG. 4) on the inner circumferential side. The return spring 57, so formed that the bore part 57A is greater than the outer diameter of the camshaft collar 155 in an unloaded state, is inserted into the outer diameter part of the camshaft collar 155 and fitted to the camshaft 151. The return spring 57, adjoining the valve cam 52, is arranged on the side opposite the intake cam 153 with the valve cam 52 in-between.

On a flank of the valve cam 52, the spring supporting hole 52C penetrating the lower part of the cam crest part 52B in the axial direction of the camshaft 151 is formed. Further, the shaft part 59A of the coupling member 59 in the holder 53 is provided with a spring supporting step 59D formed by denting the outer circumferential surface of the shaft part 59A a step.

The return spring 57 of the valve cam is fitted to the coupling member 59 by the engagement of one end 57B of the wire rod 257 extending in the axial direction of the camshaft 151 with the spring supporting hole 52C to be fitted to the valve cam 52 and the engagement of the other end 57C of the wire rod 257 extended to cross orthogonally the axial direction of the camshaft 151 with the spring supporting step 59D in a hooked way. In further detail, as shown in FIG. 4, the other end 57C is bent in an L shape and, in the portion in contact with the spring supporting step 59D, formed curvilinearly matching the curved shape of the surface of the spring supporting step 59D, and is hooked on the spring supporting step 59D from above.

The length of the coiled part of the return spring 57 of the valve cam in the axial direction of the camshaft 151 is within the distance between the flange 155A and the second plate 53B. And the position of the return spring 57 in the axial direction of the camshaft 151 is regulated by the contact of one end of the coiled part thereof with the flange 155A and the engagement of the same with the spring supporting step 59D.

Next, the procedure of assembling the camshaft structure 80 will be described with reference to FIG. 11.

The camshaft 151 has at one end the large-diameter sprocket fixing part 151A integrated with it, and the first and second plates 53A and 53B and the valve cam 52 cannot be inserted into the camshaft 151 from this end side. As a result, the structural components of the camshaft structure 80 including the first and second plates 53A and 53B and the valve cam 52 are inserted from the front side, which is the other end collar snap-on part 151D side, toward the farther inside where the sprocket fixing part 151A is positioned.

First, the first plate 53A arranged farther inside in the camshaft 151 is passed through the camshaft 151 from the collar snap-on part 151D side via the shaft holes 157A in the direction in which the convex 157B faces the sprocket fixing part 151A, and arranged overriding the intake cam 153 and between the positioning part 151B and the intake cam 153. In this process, as the bores Y of the shaft holes 157A are greater than the maximum outer diameter X of the intake cam 153, the first plate 53A can be incorporated into the camshaft 151 past the intake cam 153 formed integrally with the camshaft 151.

Next, an assembly of the sub-rocker arm 54, the connecting link 55 and the valve cam 52 is let pass the camshaft 151 from the collar snap-on part 151D side, and the valve cam 52 is fitted to the valve cam support 151C. Then, one end of the sub-rocker arm 54 is linked to the sub-rocker arm support 59B of the coupling member 59 and, at the same time, the first plate 53A and the coupling member 59 are fastened with the bolts 53D.

And the camshaft collar 155 is snapped onto the collar snap-on part 151D; the camshaft collar 155 is fixed by tightening the fixing bolts 156 at the same time with a washer 156A intervening; after that, the return spring 57 is let pass the camshaft collar 155; one end 5713 is inserted into the supporting hole 52C, and the other end 57C is hooked on the holder 53. Then, the second plate 53B is let pass the camshaft 151, the second plate 53B is fastened to the coupling member 59 with the bolt 53E, and the first and second plates 53A and 53B are integrated with the coupling member 59 to assemble the holder 53. Finally, by fitting the sub-rocker aim return spring 58 into a hole in the coupling member 59, the assembling of the camshaft structure 80 is completed.

As mentioned above, when the return spring 57 of the valve cam is assembled into the camshaft 151, the assembling is made possible by letting the return spring 57 pass the camshaft collar 155 in a state in which the sub-rocker arm 54, the connecting link 55 and the valve cam 52 are already fitted into the camshaft 151. Thus, since the return spring 57 is not yet fitted at the time the sub-rocker aim 54, the connecting link 55 and the valve cam 52 are to be assembled into the camshaft 151, no work is needed against the spring force of the return spring 57 in assembling the valve cam 52 and the sub-rocker arm 54 in. This enables the assembling ease of the valve gear 50 to be enhanced.

After that, as shown in FIG. 5A, the camshaft structure 80 is arranged on the head side supports 201A and 202A side of the cylinder head 132A, and fixed from above via the caps 201B and 202B. As the dividing faces 205 of the camshaft supports 201 and 202 substantially coincide with the axis of the camshaft 151 then, it is possible to easily fit the camshaft structure 80 to the cylinder head 132A by fixing the caps 201B and 202B after arranging the camshaft structure 80 on the head side supports 201A and 202A from above. Further, the camshaft supports 201 and 202 support the holder 53 by not only supporting the two ends of the camshaft 151 but also snapping the holder supports 201D and 202D onto the convexes 157B and 158B. For this reason, both the camshaft 151 and the holder 53 can be supported by arranging the camshaft structure 80 on the camshaft supports 201 and 202 and fixing the caps 201B and 202B, resulting in assembling ease. Further, as the holder supports 201D and 202D are coaxial with the camshaft 151, the first and second plates 53A and 53B can be supported to be oscillable centering on the camshaft 151.

Further, in the camshaft structure 80, outer circumferential surfaces 157C and 158C, which are the outer flanks of the convexes 157B and 158B of the shaft holes 157A and 158A, are snap-on fitted to inner circumferential surfaces 201E and 202E of the holder supports 201D and 202D to support the holder supports 201D and 202D from outside. Thus, as the camshaft structure 80 is supported by subsequently fixing the caps 201B and 202B after the camshaft structure 80 is arranged on the camshaft supports 201 and 202, assembling of the valve gear 50 can be simplified.

As hitherto described, in this exemplary embodiment of the application of the present invention, since the intake cam 153 is formed integrally with the camshaft 151, pressing the intake cam 153 into the camshaft 151 and like tasks become unnecessary at the assembling stage and accordingly assembling of the valve gear 50 can be simplified, the man-hours required for assembling can be reduced. In terms of the assembling procedure, as the shaft holes 157A of the first plate 53A father inside are made greater than the outer diameter of the intake cam 153 formed integrally with the camshaft 151, the first plate 53A can be let pass the intake cam 153 formed integrally with the camshaft 151, shifted farther inside than the intake cam 153 and arranged there. Therefore, assembling of the valve gear 50 is simplified to enable the man-hours required for assembling to be reduced.

Also, as the first and second plates 53A and 53B are externally supported and the holder 53 can be supported from outside via the first and second plates 53A and 53B after the first and second plates 53A and 53B have been inserted into the camshaft 151, assembling can be easily accomplished.

Furthermore, as the step 151E is provided by forming the diameter D2 of the valve cam support 151C greater than the diameter D3 of the collar snap-on part 151D on the side opposite the diameter D1 on the intake cam 153 side, the camshaft collar 155 is so inserted into the collar snap-on part 151D as to bring the flange 155A of the camshaft collar 155 into contact with the step 151E and the position of the valve cam 52 is made regulable with the flange 155A, the valve cam 52 can be positioned in the axial direction of the camshaft 151.

Also, since not only the camshaft collar 155 is used as a positioning member for the valve cam 52 but also the outer circumferential surface 155B of the camshaft collar 155 is used as a plain bearing for supporting the camshaft 151, the number of components can be reduced. In addition, as the number of components is reduced, the man-hours required for assembling can also be reduced. Furthermore, as the flange 155A of the camshaft collar 155 also serves to position the return spring 57 of the valve cam, the number of components can be reduced accordingly.

Further, as the pair of first and second plates 53A and 53B are fastened to the coupling member 59 with the bolts 53D and 53E and assembled as a solid body, the link mechanism 56, the valve cam 52, the camshaft collar 155 and the return spring 57 can be assembled at a stage before fastening the second plate 53B solidly with the bolt 53E, and the second plate 53B can be fastened after that. This facilitates arrangement and assembling of the components of the valve mechanism 50 between the first and second plates 53A and 53B, and serves to enhance the freedom in the structuring and assembling of the valve gear 50. In addition, by individually fastening the pair of first and second plates 53A and 53B to the coupling member 59 respectively with the bolts 53D and 53E, individual components of the valve mechanism 50 including the link mechanism 56, the valve cam 52, the camshaft collar 155 and the return spring 57 are enabled to be fitted while being fixed in a phased manner, the components being fitted can be prevented from coming off, resulting in increased assembling ease.

As hitherto described, in this exemplary embodiment of the application of the present invention, the return spring 57 of the valve cam is formed of a torsion coil spring, the torsion coil spring is fitted in a manner of winding it around the axis of the camshaft 151, one end 57B of the return spring 57 is bent at a right angle toward the valve cam 52, its tip is engaged with the spring supporting hole 52C of the valve cam 52, and the other end 57C of the return spring 57 is bent at a substantially right angle within a plane parallel to the surface of the sub-rocker arm 54 to engage it with the spring supporting step 59D of the holder 53 to enable the return spring 57 to be fitted to the camshaft 151. As it is thereby made possible to fit the return spring 57 by inserting the return spring 57 into the camshaft 151 after assembling the first plate 53A, the sub-rocker arm 54, the connecting link 55 and the valve cam into the camshaft 151, there is no need to fit the link mechanism 56 and the valve cam 52 while compressing the return spring 57, the assembling work can be simplified.

Also, as the return spring 57 of the valve cam is inserted into and fitted to the camshaft 151 and the return spring 57 is disposed by effectively utilizing the space on the inner circumferential side of the return spring 57, the valve gear 50 can be made smaller in size. As a result, the cylinder head 132A can be made more compact.

It is also possible to position the valve cam 52 by bringing the flange 155A of the camshaft collar 155 into contact with the valve cam 52 and to position the return spring 57 by bringing the return spring 57 into contact with the flange 155A.

Further, as it is possible to fit the return spring 57 by engaging one end 57B of the return spring 57 to the spring supporting step 59D formed on the coupling member 59 supporting the sub-rocker arm 54 and engaging the other end 57C of the return spring 57 with the supporting hole 52C in the valve cam 52 to fit it, there is no need to provide a special engaging member for the return spring 57 and, moreover, fitting can be easily accomplished. This feature makes possible reductions in the number of components and the man-hours required for assembling.

The foregoing exemplary embodiment represents one mode for carrying out the present invention, but the invention is not limited to this embodiment.

Although this embodiment has been described under the supposition that the engine 17 is a DOHC type engine, the invention is not limited to this type, and the number the camshaft(s) 151, the intake valve(s) 147 and the exhaust valve(s) 148 to be provided per cylinder are not restricted in particular; for instance, the engine may as well be an SOHC type engine. Other detailed configuration of the motorcycle 10 can obviously be altered, too, as desired.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A valve gear for an internal combustion engine provided with a camshaft that rotates in synchronism with revolution of the internal combustion engine, a drive cam that integrally rotates with the camshaft, a valve cam that rotates relative to the camshaft and opens and closes an engine valve, a link mechanism that transmits valve driving force of the drive cam to the valve cam, a holder member that supports a supporting shaft of the link mechanism and is oscillable around the camshaft, and a driving mechanism that varies a fulcrum position of the link mechanism by oscillating the holder member, a valve operating characteristic of opening and closing of the engine valve being made variable with a supporting shaft oscillating position of the link mechanism, the link mechanism comprising:

a sub-rocker arm which oscillates pivoting on the supporting shaft the fulcrum;

a pressing part operatively connected to the sub-rocker arm, said pressing part being provide for pressing a cam surface of the drive cam;

a step disposed eccentrically in an axial direction of the camshaft;

a link section for linking to the valve cam;

a spring socket operatively connected to the step; and a return spring of the sub-rocker arm disposed intervening between the spring socket and the holder member.

2. The valve gear for an internal combustion engine according to claim 1, wherein a through hole that vertically penetrates, and inserts and holds the return spring is provided in the holder member.

3. The valve gear for an internal combustion engine according to claim 2, wherein the holder member is provided with a pair of left and right holder plates and a coupling member that connects upper parts of the holder plates, and the through hole is provided in the coupling member.

4. The valve gear for an internal combustion engine according to claim 1, wherein the holder member is provided with a pair of first and second holder plates wherein the drive cam is formed integrally with the camshaft, a shaft hole to let the drive cam pass is formed at the time of fitting the first holder plate, and the first holder plate is supported from outside the shaft hole.

5. The valve gear for an internal combustion engine according to claim 4, wherein the valve cam is disposed adjacent to the drive cam, a shaft diameter of a valve cam supporting part of the camshaft is formed greater than the shaft diameter on a counter-drive cam side, a camshaft collar is inserted from the counter-drive cam side of the camshaft, and an edge of the camshaft collar is brought into contact with a step of the valve cam supporting part to position the valve cam.

6. The valve gear for an internal combustion engine according to claim 5, wherein an outer circumferential surface of the camshaft collar is formed as a plain bearing supporting the camshaft.

7. The valve gear for an internal combustion engine according to claim 4, wherein the pair of holder plates are formed into a solid body by being fastened to a sub-rocker arm supporting member supporting the fulcrum of the link mechanism with a bolt.

8. The valve gear for an internal combustion engine according to claim 1, wherein a return spring of the valve cam is formed of a torsion coil spring fitted to the camshaft, one end of the spring is engaged with the valve cam, and the other end thereof is engaged with the holder member.

9. The valve gear for an internal combustion engine according to claim 8, wherein a camshaft collar is so inserted into the camshaft as to permit positioning of the valve cam, and a return spring keep flange is provided on the valve cam side of the camshaft collar.

10. The valve gear for an internal combustion engine according to claim 8, wherein: the holder member is provided with a pair of left and right holder plates and equipped with a supporting member fitted between the pair of holder plates to serve as an oscillation fulcrum of the link mechanism; and one end of the return spring is engaged with the supporting member and the other end thereof is engaged with and fitted into a supporting hole provided in the valve cam.

11. A valve gear for an internal combustion engine provided with a camshaft that rotates in synchronism with revolution of the internal combustion engine, an intake cam that integrally rotates with the camshaft, a valve cam that rotates relative to the camshaft and opens and closes an engine valve, a link mechanism that transmits valve driving force of the intake cam to the valve cam, a holder member that supports a supporting shaft of the link mechanism and is oscillable around the camshaft, and a driving mechanism that varies a fulcrum position of the link mechanism by oscillating the holder member, a valve operating characteristic of opening and closing of the engine valve being made variable with a supporting shaft oscillating position of the link mechanism, the link mechanism comprising:

a sub-rocker arm which oscillates pivoting on the supporting shaft the fulcrum;

a roller operatively connected to the sub-rocker arm, said roller being provide for pressing a cam surface of the intake cam;

a step disposed eccentrically in an axial direction of the camshaft;

a link section for linking to the valve cam;

a spring socket operatively connected to the step; and a return spring of the sub-rocker arm disposed intervening between the spring socket and the holder member.

12. The valve gear for an internal combustion engine according to claim 11, wherein a through hole that vertically penetrates, and inserts and holds the return spring is provided in the holder member.

13. The valve gear for an internal combustion engine according to claim 12, wherein the holder member is provided with a pair of left and right holder plates and a coupling member that connects upper parts of the holder plates, and the through hole is provided in the coupling member.

14. The valve gear for an internal combustion engine according to claim 11, wherein the holder member is provided with a pair of first and second holder plates wherein the intake cam is formed integrally with the camshaft, a shaft hole to let the intake cam pass is formed at the time of fitting the first holder plate, and the first holder plate is supported from outside the shaft hole.

15. The valve gear for an internal combustion engine according to claim 14, wherein the valve cam is disposed adjacent to the intake cam, a shaft diameter of a valve cam supporting part of the camshaft is formed greater than the shaft diameter on a counter-intake cam side, a camshaft collar is inserted from the counter-intake cam side of the camshaft, and an edge of the camshaft collar is brought into contact with a step of the valve cam supporting part to position the valve cam.

16. The valve gear for an internal combustion engine according to claim 15, wherein an outer circumferential surface of the camshaft collar is formed as a plain bearing supporting the camshaft.

17. The valve gear for an internal combustion engine according to claim 14, wherein the pair of holder plates are formed into a solid body by being fastened to a sub-rocker arm supporting member supporting the fulcrum of the link mechanism with a bolt.

18. The valve gear for an internal combustion engine according to claim 11, wherein a return spring of the valve cam is formed of a torsion coil spring fitted to the camshaft, one end of the spring is engaged with the valve cam, and the other end thereof is engaged with the holder member.

19. The valve gear for an internal combustion engine according to claim 18, wherein a camshaft collar is so inserted into the camshaft as to permit positioning of the valve cam, and a return spring keep flange is provided on the valve cam side of the camshaft collar.

20. The valve gear for an internal combustion engine according to claim 18, wherein: the holder member is provided with a pair of left and right holder plates and equipped with a supporting member fitted between the pair of holder plates to serve as an oscillation fulcrum of the link mechanism; and one end of the return spring is engaged with the supporting member and the other end thereof is engaged with and fitted into a supporting hole provided in the valve cam.

* * * * *